US010805702B2

(12) United States Patent
Loeppert et al.

(10) Patent No.: US 10,805,702 B2
(45) Date of Patent: Oct. 13, 2020

(54) SYSTEMS AND METHODS FOR REDUCING NOISE IN MICROPHONES

(71) Applicant: KNOWLES ELECTRONICS, LLC, Itasca, IL (US)

(72) Inventors: Peter Loeppert, Itasca, IL (US); Michael Pedersen, Itasca, IL (US); Michael Kuntzman, Itasca, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 16/410,748

(22) Filed: May 13, 2019

(65) Prior Publication Data

US 2019/0356974 A1 Nov. 21, 2019

Related U.S. Application Data

(60) Provisional application No. 62/780,869, filed on Dec. 17, 2018, provisional application No. 62/673,585, filed on May 18, 2018.

(51) Int. Cl.

| | |
|---|---|
| ***H04R 1/08*** | (2006.01) |
| ***H04R 1/04*** | (2006.01) |
| ***H04R 19/04*** | (2006.01) |

(52) U.S. Cl.

CPC ..... *H04R 1/083* (2013.01); *H04R 1/04* (2013.01)

(58) Field of Classification Search

None

See application file for complete search history.

(56) References Cited

U.S. PATENT DOCUMENTS

| | | | | |
|---|---|---|---|---|
| 7,190,038 | B2 | 3/2007 | Dehe et al. | |
| 7,372,110 | B2 * | 5/2008 | Hatano | H01L 27/12 257/379 |
| 7,473,572 | B2 | 1/2009 | Dehe et al. | |

(Continued)

FOREIGN PATENT DOCUMENTS

| | | | |
|---|---|---|---|
| EP | 2 019 298 | A1 | 1/2009 |
| WO | WO-2015/189598 | A1 | 12/2015 |
| WO | WO-2018/035669 | A1 | 3/2018 |

OTHER PUBLICATIONS

International Search Report and Written Opinion for International Application No. PCT/US2019/032034, dated Aug. 13, 2019, 15 pages.

*Primary Examiner* — Qin Zhu

(74) *Attorney, Agent, or Firm* — Foley & Lardner LLP

(57) ABSTRACT

A microphone assembly comprises a substrate and an enclosure disposed on the substrate. A port is defined in one of the substrate or the enclosure. An acoustic transducer is configured to generate an electrical signal in response to acoustic activity. The acoustic transducer comprises a membrane separating a front volume from a back volume of the microphone assembly. The front volume is in fluidic communication with the port, and the back volume is filled with a first gas having a thermal conductivity lower than a thermal conductivity of air. An integrated circuit is electrically coupled to the acoustic transducer and configured to receive the electrical signal from the acoustic transducer. At least a portion of a boundary defining at least one of the front volume or the back volume is configured to have compliance so as to allow pressure equalization. The first gas is different from the second gas.

16 Claims, 20 Drawing Sheets

(56) References Cited

U.S. PATENT DOCUMENTS

| | | | | |
|---|---|---|---|---|
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 8,254,209 | B2 * | 8/2012 | Yamanaka | B06B 1/02 367/118 |
| 2005/0201575 | A1 * | 9/2005 | Koshida | G10K 15/04 381/164 |
| 2005/0207605 | A1 | 9/2005 | Dehe et al. | |
| 2007/0278501 | A1 | 12/2007 | Macpherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2008/0287561 | A1 * | 11/2008 | Menashi | C08J 9/0066 521/142 |
| 2009/0001553 | A1 | 1/2009 | Pahl et al. | |
| 2009/0041274 | A1 | 2/2009 | Rass | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2017/0230758 | A1 | 8/2017 | Kuntzman et al. | |
| 2017/0325013 | A1 | 11/2017 | Dehe et al. | |
| 2019/0007759 | A1 * | 1/2019 | Meisel | B81B 7/0061 |
| 2020/0055726 | A1 * | 2/2020 | Deas | B81B 3/0081 |

* cited by examiner

SYSTEMS AND METHODS FOR REDUCING NOISE IN MICROPHONES

CROSS-REFERENCE TO RELATED APPLICATIONS

The present application claims priority to and benefit of U.S. Provisional Application No. 62/673,585 filed May 18, 2018, and U.S. Provisional Application No. 62/780,869 filed Dec. 17, 2018, the disclosures of which is hereby incorporated by reference herein in their entirety.

TECHNICAL FIELD

The present disclosure relates generally to systems and methods of improving signal to noise ratio in microphones.

BACKGROUND

Microphone assemblies are generally used in electronic devices to convert acoustic energy to electrical signals. Advancements in micro and nanofabrication technologies have led to the development of progressively smaller micro-electro-mechanical-system (MEMS) microphone assemblies. The small size of MEMS microphone assemblies can make them prone to noise issues.

SUMMARY

Embodiments described herein relate generally to systems and methods for reducing noise in microphone assemblies, and in particular, to microphone assemblies that have a low thermal conductivity gas filled in an internal volume defined by enclosures of the microphone assemblies and/or a thermal barrier layer disposed on at least a portion of a wall of the enclosure.

In some embodiments, a microphone assembly comprises a substrate and an enclosure disposed on the substrate. A port is defined in one of the enclosure or the substrate. The microphone assembly also comprises an acoustic transducer configured to generate an electrical signal in response to acoustic activity. The acoustic transducer comprises a membrane separating a front volume from a back volume of the microphone assembly, the front volume being in fluidic communication with the port, and the back volume filled with a first gas having a thermal conductivity lower than a thermal conductivity of air. An integrated circuit is electrically coupled to the acoustic transducer and configured to receive the electrical signal from the acoustic transducer. At least a portion of a boundary defining at least one of the front volume or the back volume is configured to have compliance so as to allow expansion or contraction of the first gas in response to changes in pressure of a second gas surrounding the microphone assembly and allow equalization of pressure therewith. The first gas is different from the second gas.

In some embodiments, a microphone assembly comprises a substrate and an enclosure disposed on the substrate. A port is defined in one of the substrate or the enclosure. The microphone assembly also comprises an acoustic transducer configured to generate an electrical signal in response to acoustic activity. The acoustic transducer comprises a membrane separating a front volume from a back volume of the microphone assembly, the front volume being in fluidic communication with the port. An integrated circuit is electrically coupled to the acoustic transducer and configured to receive the electrical signal from the acoustic transducer. A thermal barrier layer is positioned on at least one interior surface of a boundary defining the back volume. The thermal barrier layer is formulated to have a thermal conductivity less than a thermal conductivity of air.

In some embodiments, a method of forming a microphone assembly comprises providing a substrate and an enclosure. A port is defined in one of the substrate or the enclosure. An acoustic transducer is positioned on one of the substrate or the enclosure. The acoustic transducer comprises a membrane and is configured to generate an electrical signal responsive to acoustic activity. An integrated circuit is electrically coupled to the acoustic transducer. The enclosure is disposed on the substrate such that the membrane separates a space between the substrate and the enclosure into a front volume being in fluidic communication with the port, and a back volume. The back volume is filled with a first gas having a thermal conductivity lower than a thermal conductivity of air.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
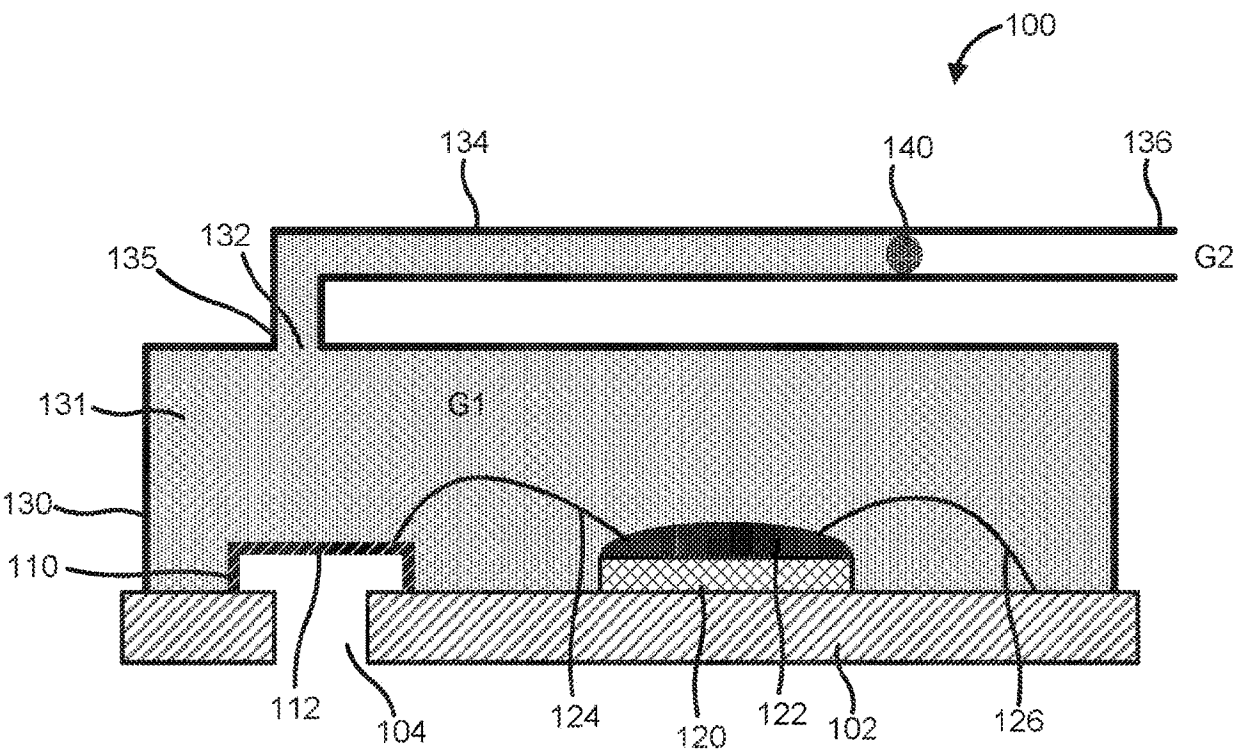
FIG. 1 is a side cross-section view of a microphone assembly, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to systems and methods for reducing noise in a microphone assembly, and in particular, to microphone assemblies that have a low thermal conductivity gas filled in an internal volume defined by an enclosure of the microphone assembly and/or a thermal barrier layer disposed on at least a portion of a wall of the enclosure.

Small MEMS microphone assemblies have allowed incorporation of such microphone assemblies in compact devices such as cell phones, laptops, wearables, TV/set-top box remotes, etc. The MEMS microphone industry faces continuous demand to reduce footprint, package volume, power consumption and cost while increasing performance and reliability. Generally, the enclosure which houses the components of the microphone assembly is filled with air. A small hole or aperture is defined in the acoustic transducer (e.g., a membrane) to allow flow of air from outside the enclosure to inside thereof, and vice versa so as to balance the pressure of air on either sides of the acoustic transducer at low frequencies. Miniaturization of MEMS microphone assemblies has allowed enclosures of the MEMS microphone assemblies to have very small internal volumes, for example, in a range of 1-5 $mm^3$.

However such MEMS microphone assemblies pose other unique challenges, particularly because of their small dimensions. For example, the enclosure is generally formed from a material which is a good conductor of heat. A thermal boundary layer may exist at the inner surface of the walls of the enclosure, the substrate and all other surfaces present within the enclosure. While the thermal boundary layer is generally not a problem in large microphones, the large surface to volume ratio provided by the small volumes defined by the enclosure of MEMS microphone assemblies tremendously increases the surface to volume ratio of MEMS microphone assemblies. Heat transfer between the air in the internal volume and the thermal boundary causing even micro Kelvin changes in air temperature is a significant thermo-acoustic noise source in MEMS microphones having a frequency in the audible range. This noise may even exist in the absence of an acoustic signal and in some cases, may account for 50% of the total noise in MEMS microphones. Although the thermal boundary layer effect is most prominent for small enclosure sizes, it can limit the performance of devices with relatively larger enclosures if the other noise sources in the system are pushed low enough.

Expanding further, acoustic compression of the air inside the enclosure which houses components of MEMS microphone assembly is typically considered to occur quickly enough relative to the rate of thermal diffusion that it can be considered adiabatic, with impedance given by:

$$Z_a = \frac{\gamma p_o}{j\omega V} = \frac{1}{j\omega C_a} \tag{1}$$

and uniform temperature oscillation amplitude, given by:

$$T_a = \frac{pT_o(\gamma - 1)}{p_o\gamma} \tag{2}$$

where $\omega=2\pi f$ is the radial frequency, $C_\alpha$ is the adiabatic compliance of the air volume, $p_o$ is the ambient pressure, $\gamma$ is the ratio of specific heats for the gas inside the enclosure, V is the volume of the enclosure, $T_o$ is the ambient temperature, and p is pressure amplitude in the enclosure due to acoustic excitation. However, heat transfer at the walls of the enclosure causes a thermal boundary layer to form, which can result in significant spatial variation of the temperature amplitude within the enclosure. The enclosure walls are usually made of materials, such as metals, which have significantly higher thermal conductivity than air and are typically approximated as isothermal boundaries. Assuming the wall is an isothermal boundary and ignoring the influence of adjacent walls, the thermal boundary layer thickness is given by:

$$\delta_t = \sqrt{\frac{2\kappa}{\omega\rho_0 C_p}} \tag{3}$$

where $\rho_0$ is the density, $\kappa$ is the thermal conductivity, and $C_p$ is the specific heat at constant pressure of the gas inside the enclosure. For cases in which the thermal boundary layer becomes sufficiently large relative to the enclosure dimensions, which occurs for small enclosures and at low frequencies, compression of the air within the enclosure transitions from adiabatic to isothermal and a correction to the adiabatic cavity impedance becomes necessary. While air is generally a good insulator, the thermal time constant of air causes the air in the enclosure to have a rate of heat transfer with the thermal boundary layer at a frequency which is in the audible range, i.e., the operational range of the MEMS microphone. Heat transfer at the enclosure walls dissipates energy from the system and results in acoustic damping, which contributes thermo-acoustic noise according to the fluctuation-dissipation theorem. For operation under standard conditions, the noise is a function only of the package dimensions and becomes more prominent as other noise sources in the system are lowered through design optimization.

In contrast, embodiments of the microphone assemblies described herein may provide benefits including, for example: (1) filling a back volume of an acoustic transducer such as an internal volume of an enclosure of the microphone assembly with a first gas having a thermal conductivity lower than the thermal conductivity and having a larger thermal time constant to that of air so as to reduce noise; (2) fluidly sealing the first gas in the internal volume by optionally eliminating the hole or piercing from an acoustic transducer (e.g., a membrane) of the microphone assembly; (3) providing a movable sealing member which displaces in a conduit fluidly coupled to the enclosure so as to balance a pressure of the first gas with a pressure of a second gas (e.g., air) surrounding the microphone assembly and prevents pressure imbalance; (4) reducing heat transfer by coating one or more inner surfaces of the enclosure and/or the substrate with low thermal conductivity thermal barrier layer; and/or (5) allowing a signal-to-noise ratio (SNR) increase of up to or greater than 2 dB.

FIG. 1 is a side cross-section view of a microphone assembly 100, according to an embodiment. The microphone assembly 100 may comprise a MEMS microphone assembly. The microphone assembly 100 may be used for converting acoustic signals into electrical signals in any device such as, for example, cell phones, laptops, television remotes, tablets, audio systems, headphones, wearables, portable speakers, car sound systems or any other device that uses a microphone assembly.

The microphone assembly 100 comprises a substrate 102, an acoustic transducer 110, an integrated circuit 120 and an enclosure 130. The substrate 102 can be formed from materials used in printed circuit board (PCB) fabrication (e.g., plastics). For example, the substrate may include a PCB configured to mount the acoustic transducer 110, the integrated circuit 120 and the enclosure 130 thereon. A port 104 is formed in the substrate 102. The acoustic transducer 110 is positioned on the port 104. The acoustic transducer 110 is configured to generate an electrical signal responsive to an acoustic signal.

In FIG. 1, the acoustic transducer 110 and the integrated circuit 120 are shown disposed on a surface of the substrate 102, but in other embodiments one or more of these components may be disposed on the enclosure 130 (e.g., on an inner surface of the enclosure) or sidewalls of the enclosure or stacked atop one another. In some embodiments, the substrate 102 includes an external-device interface having a plurality of contacts coupled to the integrated circuit 120, for example, to connection pads (e.g., bonding pads) which may be provided on the integrated circuit. The contacts may be embodied as pins, pads, bumps or balls among other known or future mounting structures. The functions and number of contacts on the external-device interface depend on the protocol or protocols implemented and may include power, ground, data, and clock contacts among others. The external-device interface permits integration of the microphone assembly 100 with a host device using reflow-soldering, fusion bonding, or other assembly processes.

In various embodiments, the acoustic transducer 110 may comprise a membrane 112 have a thickness in a range of 1-10 microns. It should be appreciated that while conventional membranes used in microphone assemblies include a hole or piercing for pressure equalization, the membrane 112 of the acoustic transducer 110 does not include such a hole or piercing, in some implementations. The membrane 112 may separate a front volume from a back volume of the microphone assembly 100. The front volume is in fluidic communication with an acoustic port defined in either the substrate 102 or the enclosure 130. The embodiment shown in FIG. 1 includes a bottom port microphone assembly 100 in which a port 104 is defined in the substrate 102 such that an internal volume 131 of the enclosure 130 defines the back volume. It should be appreciated that in other embodiments, such as those described in detail below, the concepts described herein may be implemented in a top port microphone assembly in which the port is defined in an enclosure or cover of the microphone assembly.

In some implementations, the acoustic transducer 110 may include a MEMS transducer embodied as a condenser-type transducer having a membrane 112 (e.g., a diaphragm) movable relative to a back plate in response to changes in acoustic pressure. Alternatively, the MEMS acoustic transducer 110 may include a piezoelectric device, or some other known or future electro-acoustic transduction device implemented using MEMS technology. In still other implementations, the acoustic transducer 110 is a non-MEMS device embodied, for example, as an electret or other known or future non-MEMS type transduction device. These and other electro-acoustic transduction devices are known generally and are not described further except to the extent necessary to make and use the embodiments disclosed herein.

In some embodiments, the acoustic transducer 110 may be formed from a dielectric and/or conductive material (e.g., silicon oxide, silicon nitride, silicon carbide, gold, aluminum, platinum, etc.). Movement of the membrane 112 in response to the acoustic signal may generate an electrical signal (e.g., a voltage corresponding to a change in capacitance thereof), which may be measured and is representative of the acoustic signal. In some implementations, vibration of the membrane relative to a back plate (e.g., a fixed back plate) causes changes in the capacitance between the membrane 112 and the back plate and corresponding changes in the generated electrical signal. In other embodiments, the acoustic transducer 110 may be formed from a piezoelectric material, for example, quartz, lead titanate, III-V and II-VI semi-conductors (e.g., gallium nitride, indium nitride, aluminum nitride, zinc oxide, etc.), graphene, ultra nanocrystalline diamond, polymers (e.g., polyvinylidene fluoride) or any other suitable piezoelectric material. In such embodiments, vibration of the acoustic transducer 110 in response to the acoustic signal may generate an electrical signal (e.g., a piezoelectric current or voltage) which is representative of the acoustic signal.

An integrated circuit 120 may be positioned on the substrate 102. The integrated circuit 120 is electrically coupled to the acoustic transducer 110, for example, via a first electrical lead 124 and also to the substrate 102 (e.g., to a trace or other electrical contact disposed on the substrate 102) via a second electrical lead 126. The integrated circuit 120 receives an electrical signal from the transducer and may amplify and condition the signal before outputting a digital or analog acoustic signal as is known generally. The integrated circuit 120 may also include a protocol interface, not shown, depending on the output protocol desired. The transducer assembly 100 may also be configured to permit programming or interrogation thereof as described herein. Exemplary protocols include but are not limited to PDM, PCM, SoundWire, I2C, I2S and SPI, among others.

The integrated circuit 120 is configured to receive the electrical signal from the acoustic transducer 110. For example, the integrated circuit 120 may receive an electrical signal from the acoustic transducer 110 having a characteristic (e.g., voltage) that changes responsive to changes in capacitance in the acoustic transducer 110 (e.g., capacitance changes between a diaphragm and a back plate of the acoustic transducer 110), or receive a piezoelectric current from the acoustic transducer 110 which is representative of the acoustic signal.

The integrated circuit 120 may include one or more components, for example, a processor, a memory, and/or a communication interface. The processor may be implemented as one or more general-purpose processors, an application specific integrated circuit (ASIC), one or more field programmable gate arrays (FPGAs), a digital signal processor (DSP), a group of processing components, or other suitable electronic processing components. In other embodiments, the DSP may be separate from the integrated circuit 120 and in some implementations, may be stacked on the integrated circuit 120. In some embodiments, the one or more processors may be shared by multiple circuits and, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

In some embodiments, the integrated circuit 120 may include a memory. The memory (e.g., RAM, ROM, Flash Memory, hard disk storage, etc.) may store data and/or computer code which may be executable by the processor included in the integrated circuit 120. The memory may be or include tangible, non-transient volatile memory or non-volatile memory. Accordingly, the memory may include database components, object code components, script components, or any other type of information structure for supporting the various activities and information structures of the microphone assembly 100. In various embodiments, the integrated circuit 120 may also include one or signal amplification circuitry (e.g., transistors, resistors, capacitors, operational amplifiers, etc.) or noise reduction circuitry (e.g., low pass filters, high pass filters, band pass filters, etc.). In other embodiments, the integrated circuit 120 may include analog-to-digital conversion circuitry configured to convert an analog electrical signal from the acoustic transducer 110 into a digital signal.

A protective coating 122 may be positioned on the integrated circuit 120, in some implementations. The protective coating 122 may include, for example a silicone gel, a laminate, or any other protective coating configured to protect the integrated circuit 120 from moisture and/or temperature changes.

The enclosure 130 is positioned on the substrate 102. The enclosure 130 defines the internal volume 131 within which at least the integrated circuit 120 and the acoustic transducer 110 is positioned. For example, as shown in FIG. 1, the enclosure 130 is positioned on the substrate 102 such that the substrate 102 forms a base of the microphone assembly 100, and the substrate 102 and the enclosure 130 cooperatively define the internal volume 131. As previously described herein, the internal volume 131 defines the back volume of the acoustic transducer 110.

The enclosure 130 may be formed from a suitable material such as, for example, metals (e.g., aluminum, copper, stainless steel, etc.), plastics, polymers, etc., and may be coupled to the substrate 102, for example, via an adhesive, soldered or fusion bonded thereto. In particular embodiments, the enclosure 130 may be formed from a material which has a high heat capacity, for example, metals such as copper or brass. In the illustrated embodiment, the enclosure 130 is directly coupled to the substrate 102.

An opening 132 is defined in a wall of the enclosure 130. The microphone assembly 100 also comprises a conduit 134. A conduit first end 135 of the conduit 134 is fluidly coupled to the opening 132 and a conduit second end 136 of the conduit 134 opposite the conduit first end 135 is open to the environment, so as to be exposed to a second gas G2 surrounding the microphone assembly 100 (e.g., ambient air). The internal volume 131 of the enclosure 130 is filled with a first gas G1 which has a thermal conductivity which is lower than a thermal conductivity of the second gas G2 (e.g., ambient air) and a thermal time constant which is larger than the thermal time constant of the second gas G2 so as to reduce the impact of thermo-acoustic noise. In some embodiments, the conduit 134 has an L-shape as shown in FIG. 1, for example, to lower a profile of the conduit 134. In other embodiments, the conduit 134 may not have any bends and may extend axially or radially from the wall of the enclosure 130.

The first gas G1 may be filled in the internal volume 131 defined by the enclosure 130 using any suitable process. For example, the microphone assembly 100 may be placed in a vacuum chamber so as to remove any air present within the internal volume. The first gas G1 is then inserted in to the vacuum chamber so as to fill the internal volume 131 with the first gas G1. In other embodiments, positive pressure may be used to insert the first gas G1 into the internal volume 131 through the conduit 134. In such embodiments, a small hole or aperture maybe provided in the enclosure 130 to allow any air present within the internal volume to escape therefrom as the first gas G1 is pumped into the internal volume. Once the internal volume 131 and the conduit 134 are completely filled with the second gas G2, the hole or aperture defined in the enclosure 130 may be sealed.

As previously described, the first gas G1 has a thermal conductivity lower than the thermal conductivity of the second gas G2 (e.g., air) surrounding the microphone assembly 100. Such gases may include but are not limited to sulfur hexafluoride, xenon, Freon, dicholorodifluoromethane, argon, krypton or any suitable combination thereof. In particular embodiments, the second gas comprises sulfur hexafluoride. Sulfur hexafluoride has a thermal conductivity of $11.6\times10^{-3}$ W/mK which is significantly lower than the thermal conductivity of air which is $25.7\times10^{-3}$ W/mK. This allows sulfur hexafluoride to have a larger thermal time constant to air so as to have a slow thermal response and limit the impact of thermo-acoustic noise and thereby, an increase in the SNR. In some embodiments, filling the internal volume 131 with sulfur hexafluoride may lead to a 2 dB or greater increase in a SNR of the microphone assembly 100.

In order to fluidly seal the first gas G1 inside the internal volume 131, as well as allow equalization of pressures of the second gas G2 with the first gas G1, a movable sealing member 140 is positioned in the conduit 134. The movable sealing member 140 may comprise a droplet of at least one of a mineral oil or synthetic oil. In particular embodiments, the movable sealing member 140 comprises a droplet of perfluoropolyether oil (e.g., the oil available under the trade name FOMBLIN®). In other embodiments, the movable sealing member 140 may comprise a roller ball, a movable disc or any other suitable movable sealing member.

The movable sealing member 140 is configured to slide or translate within the conduit 134 in response to changes in ambient pressure of the second gas G2. For example, FIG. 1 shows the microphone assembly 100 in an initial configuration in which the second gas G2 may have the same pressure as the first gas G1 and the movable sealing member 140 may be located near a midpoint along a length of the conduit 134.

Figure 1A:
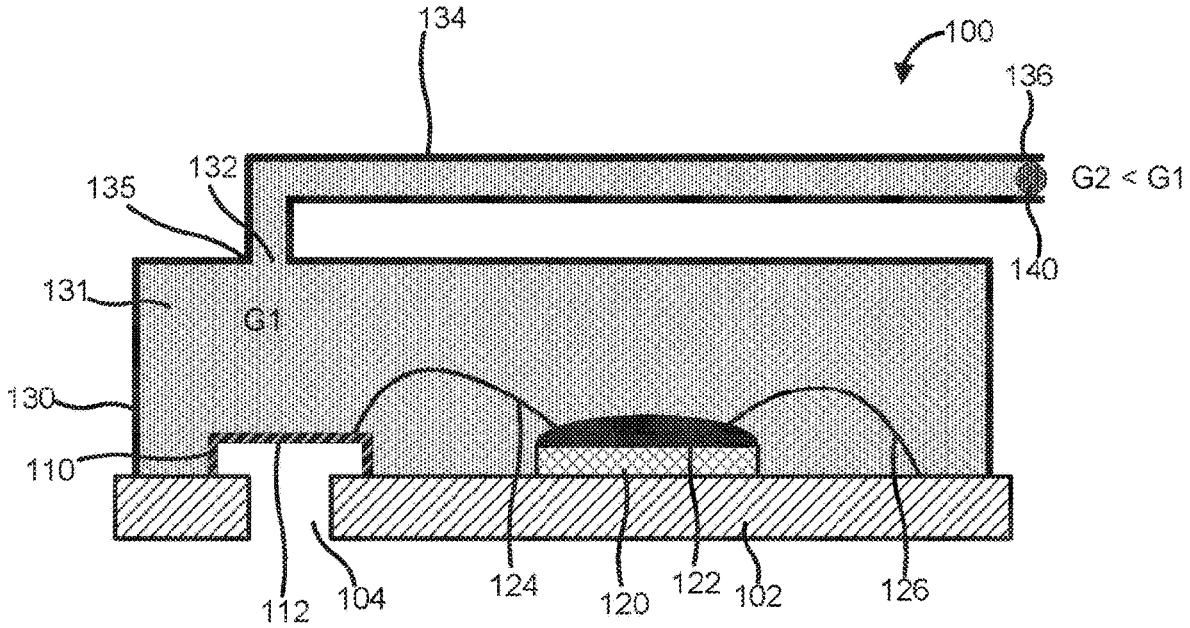
FIG. 1A is a side cross-section of the microphone assembly of FIG. 1 in a first configuration.
Figure 1B:
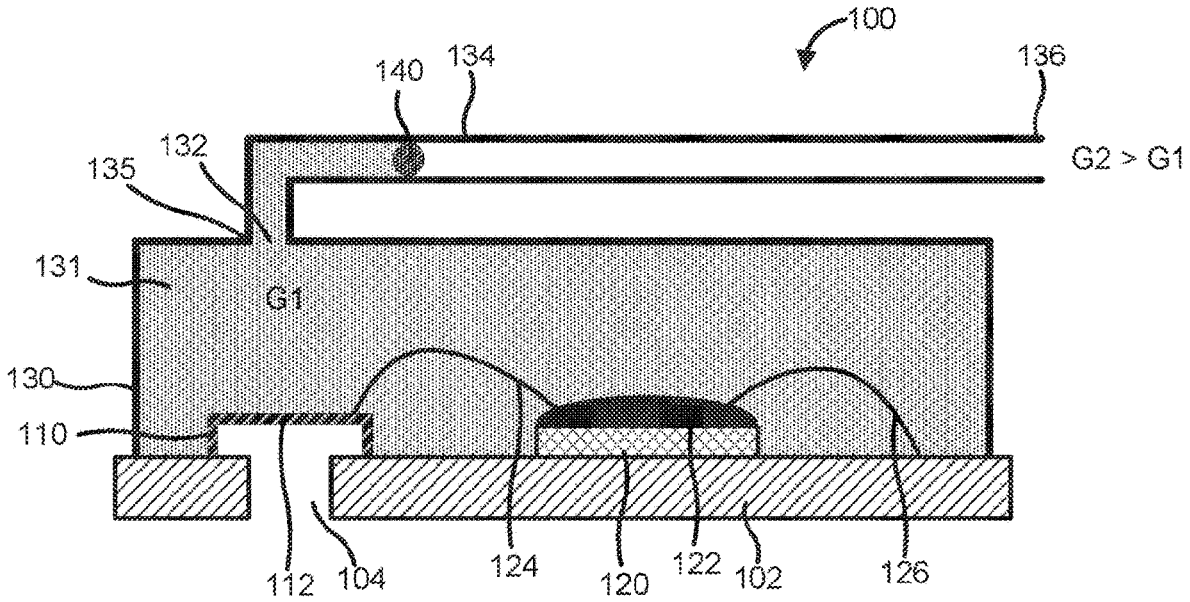
FIG. 1B is a side cross-section of the microphone assembly of FIG. 1 in a second configuration.

FIG. 1A shows the microphone assembly 100 in a first configuration in which the ambient pressure of the second gas G2 is lower than in FIG. 1. The lower pressure of the second gas G2 causes the movable sealing member 140 to move outwardly towards the conduit second end 136. This allows the first gas G1 to expand so as to lower a pressure thereof and to match the pressure of the second gas G2. FIG. 1B shows the microphone assembly 100 in a second configuration in which the ambient pressure of the second gas G2 is greater than that in FIG. 1. The higher pressure of the second gas G2 causes the movable sealing member 140 to move inwardly towards the conduit first end 135. This compresses the first gas G1, therefore increasing a pressure of the first gas G1 until the pressure of the first gas G1 matches the ambient pressure of the second gas G2. In this manner, the microphone assembly 100 provides reduction in thermo-acoustic noise by backfilling the internal volume of the enclosure 130 with a low thermal conductivity first gas G1, provides fluid sealing of the first gas G1 in the internal volume by eliminating the hole or piercing from the acoustic transducer 110, as well as allows pressure equalization by providing the movable sealing member 140.

Figure 2:
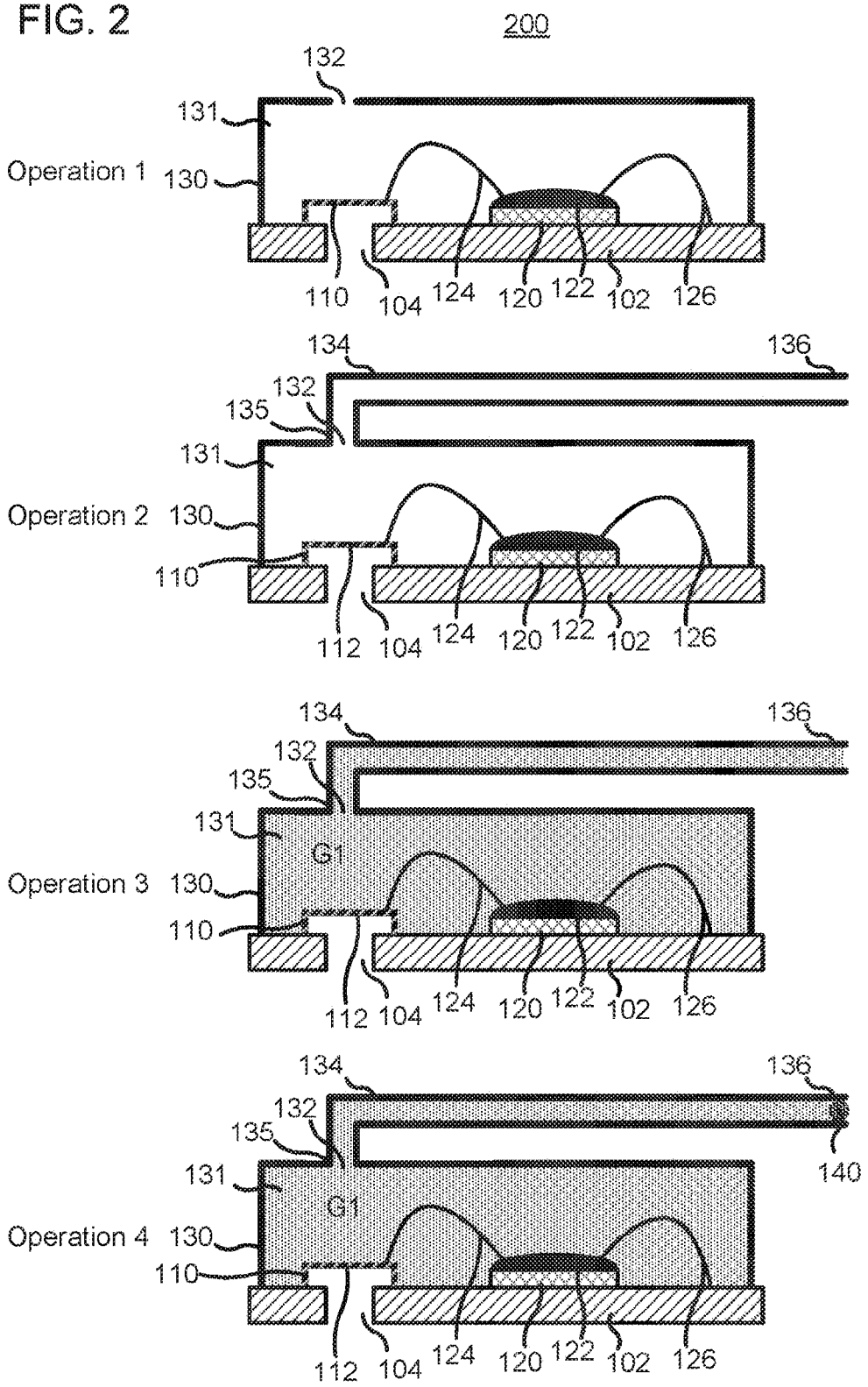
FIG. 2 is a schematic illustration of an example process for fabricating a microphone assembly of FIG. 1.

FIG. 2 is a schematic illustration of an example process 200 for fabricating the microphone assembly 100 of FIG. 1. At operation 1, the substrate 102 with the acoustic transducer 110, the integrated circuit 120 and the enclosure 130 positioned thereon is provided. The opening 132 is defined in the enclosure 130, for example, before or after the enclosure 130 is coupled to the substrate 102. At operation 2, the conduit first end 135 of the conduit 134 is coupled to the opening 132. In other embodiments, the conduit 134 may be coupled to the enclosure 130 before the enclosure 130 is positioned on the substrate 102. The conduit first end 135 may be coupled to the opening 132 using any suitable process, for example, soldering, welding, fusion bonding, an adhesive or a combination thereof.

At operation 3, the internal volume 131 defined by the enclosure 130, which forms the back volume of the acoustic transducer 110 in this implementation, is filled with the first gas G1. For example, the first gas G1 may be inserted into the internal volume 131 via the conduit 134 such that at least a portion of the conduit 134 may also be filled with the first gas G1. The first gas G1 may be filled into the internal volume using any suitable process, for example, via vacuum filling or using positive pressure, as previously described herein. In some embodiments, the enclosure 130 may be evacuated between 10 Pa and 100 Pa, and filled with the first gas G1 (e.g., sulfur hexafluoride) at a pressure between 50 kPa and 70 kPa.

At operation 4, a movable sealing member 140 is positioned in the conduit 134, for example, through the conduit second end 136. The movable sealing member 140 may comprise, for example, a droplet of a mineral or synthetic oil (e.g., a perfluoropolyether oil such as FOMBLIN®). In some embodiments, the droplet of the oil may be disposed on an inlet defined at the conduit second end 136. The oil droplet may then be drawn into the conduit 134, for example, via capillary action, positive pressure exerted on the inlet or a slight negative pressure of the first gas G1 (e.g., created by deflecting the acoustic transducer 110). For example, a droplet of FOMBLIN® oil may inserted into the inlet of the conduit second end 136 at the low pressure described in operation 3, and the microphone assembly 100 is returned to ambient atmospheric pressure. This may force the droplet into the conduit 134 allowing it to move in both directions in response to increasing or decreasing atmospheric pressure conditions.

Figure 3:
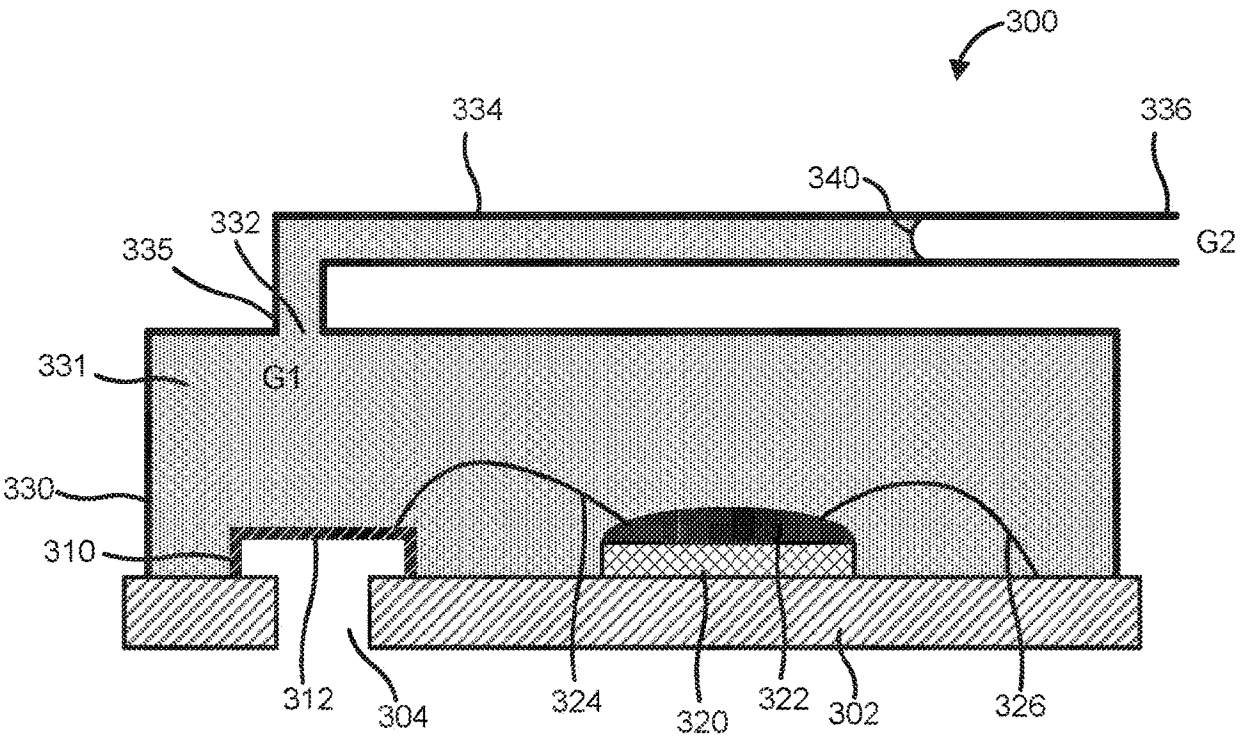
FIG. 3 is a side cross-section of a microphone assembly, according to another embodiment.

FIG. 3 is a side cross-section of a microphone assembly 300, according to another embodiment. The microphone assembly 300 may comprise a MEMS microphone assembly. The microphone assembly 300 may be used for recording sound in any device such as, for example, cell phones, laptops, television remotes, tablets, audio systems, head phones, wearables, portable speakers, car sound systems or any other device which uses a microphone assembly.

The microphone assembly 300 comprises a substrate 302. A port 304 is formed in the substrate 302. An acoustic transducer 310 may be positioned on the port 304. The acoustic transducer 310 is configured to generate an electrical signal responsive to acoustic activity. The acoustic transducer 310 comprises a membrane 312 separating a front volume from a back volume of the microphone assembly 300, the front volume being in fluidic communication with the port 304. An integrated circuit 320 is positioned on the substrate 302. The integrated circuit 320 is electrically coupled to the acoustic transducer 310, for example, via a first electrical lead 324 and also to the substrate 302 via a second electrical lead 326. The integrated circuit 320 is configured to receive the electrical signal from the acoustic transducer 310 and/or bias the acoustic transducer 310. A protective coating 322 may be positioned on the integrated circuit 320. An enclosure 330 is positioned on the substrate 302 and defines an internal volume within which at least the integrated circuit 320 and the acoustic transducer 310 are positioned. An opening 332 may be defined in a wall of the enclosure 330. The microphone assembly 300 also comprises a conduit 334. A conduit first end 335 of the conduit 334 is fluidly coupled to the opening 332 and a conduit second end 336 of the conduit 334 opposite the conduit first end 335 is open to the environment, so as to be exposed to a second gas G2 surrounding the microphone assembly 300 (e.g., ambient air). The substrate 302, the acoustic transducer 310, the integrated circuit 320, the enclosure 330 and the conduit 334 may be substantially similar to the substrate 102, the acoustic transducer 110, the integrated circuit 120, the enclosure 130 and the conduit 134, respectively and therefore, not described in further detail herein.

The internal volume 331 of the enclosure 330 (i.e., the back volume of the acoustic transducer) is filled with a first gas G1 which has a thermal conductivity which is lower than a thermal conductivity of the second gas G2 (e.g., ambient or atmospheric air). Such gases may include but are not limited to sulfur hexafluoride, xenon, dicholorodifluoromethane, argon, Freon, krypton or any suitable combination thereof. In particular embodiments, the first gas G1 comprises sulfur hexafluoride.

In order to fluidly seal the first gas G1 inside the internal volume, as well as allow equalization of the pressure of the first gas G1 with the pressure of the second gas G2, a flexible sealing member 340 is positioned in the conduit 334. The flexible sealing member 340 may include, for example, a diaphragm configured to flex or otherwise experience a change in shape in response to a change in the ambient pressure of the second gas G2 so as to allow equalization or balancing of the pressure of the first gas G1 with the pressure of the second gas G2 dropping. For example, the flexible sealing member 340 may flex outwards towards the conduit second end 336 in response to the pressure of the second gas G2 being lower than the pressure of the first gas G1. This may allow the first gas G1 to expand lowering the pressure thereof to match the ambient pressure of the second gas G2. Similarly, the flexible sealing member 340 may flex inwards towards the conduit first end 335 in response to the ambient pressure of the second gas G2 rising, compressing the first gas G1 and increasing a pressure thereof to match the ambient pressure of the second gas G2. In particular embodiments, the flexible sealing member 340 may be positioned in the opening 332, and be configured to flex inwards or outwards relative to the opening 332 so as to allow equalization of pressure of the gases G1 and G2. In such embodiments, the conduit 334 may be excluded.

Figure 4:
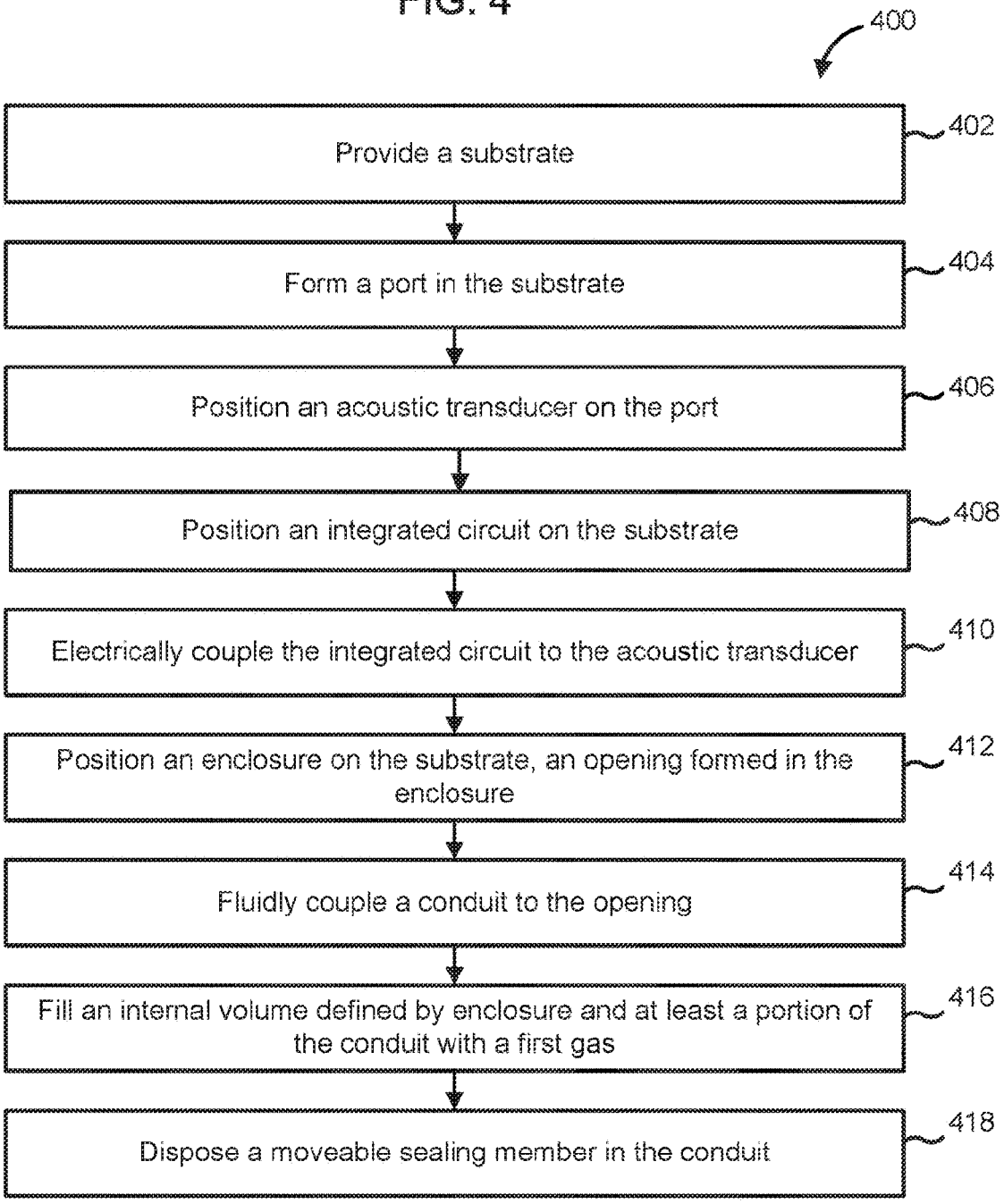
FIG. 4 a schematic flow diagram of a method for fabricating a microphone assembly, according to an embodiment.

FIG. 4 is a schematic flow diagram of an example method 400 for fabricating a microphone assembly (e.g., the microphone assembly 100, 300), according to an embodiment. The method 400 may comprise providing a substrate, at 402. The substrate may comprise, for example, the substrate 102 or any other substrate described herein. At 404, a port is formed in the substrate. For example, the port 104 may be formed in substrate 102 (e.g., chemically etched, physically etched, drilled, formed during a molding process of the substrate 102, etc.).

At 406, an acoustic transducer is positioned on the port. For example, the acoustic transducer 110 is positioned on the port 104. At 408, an integrated circuit is positioned on the substrate. For example, the integrated circuit 120 or any other integrated circuit described herein is positioned on the substrate 102, and may be electrically coupled thereto (e.g., via reflow bonding).

At 410, the integrated circuit is electrically coupled to the acoustic transducer. For example, the integrated circuit 120 is electrically coupled to the acoustic transducer 110 via the first electrical lead 124 (e.g., wire bonded thereto). In other embodiments, a protective coating (e.g., the protective coating 122) may also be deposited on the integrated circuit (e.g., the integrated 120).

At 412, an enclosure having an opening formed in a wall thereof, is positioned on the substrate. For example, the enclosure 130 having the opening 132 defined in the wall thereof is positioned on the substrate 102, and coupled thereto (e.g., via an adhesive or solder). At 414, a conduit is fluidly coupled to the opening. For example, the conduit first end 135 of the conduit 134 is fluidly coupled to the opening 132. In other embodiments, the conduit 134 may be coupled to the opening 132 before the enclosure 130 is positioned on the substrate 102.

At 416, an internal volume defined by the enclosure, and at least a portion of the conduit is filled with a first gas. For example, the internal volume 131 defined by the enclosure 130 (e.g., a back volume of the acoustic transducer 110), and at least a portion of the conduit 134 is filled with the first gas G1 (e.g., sulfur hexafluoride). The internal volume may be filled with the first gas using any suitable process, e.g., vacuum backfilling, positive pressure insertion, or any other suitable process as previously described herein. At 418, a movable sealing member is disposed in the conduit. For example, the movable sealing member 140 (e.g., a droplet of mineral oil or synthetic oil such as FOMBLIN®) may be disposed in the conduit 134, as previously described herein. The movable sealing member fluidly seals the first gas in the internal volume and allows expansion and/or compression of the first gas for balancing a pressure thereof with an ambient pressure of a second gas (e.g., the second gas G2 such as air) surrounding the microphone assembly (e.g., the microphone assembly 100).

Figure 5A:
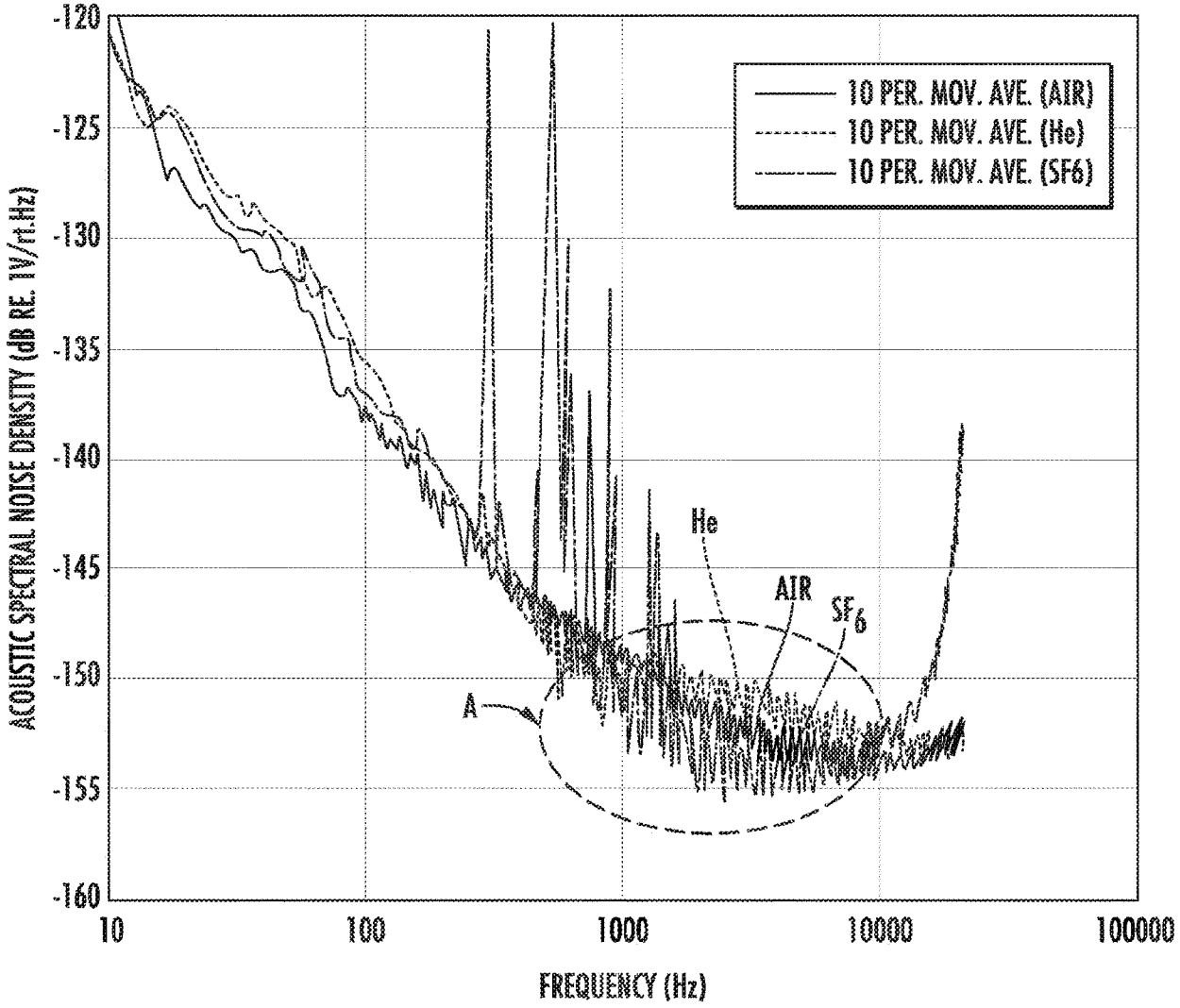
FIG. 5A is a plot of acoustic spectral noise density vs frequency of a microphone assembly backfilled with sulfur hexafluoride.
Figure 5B:
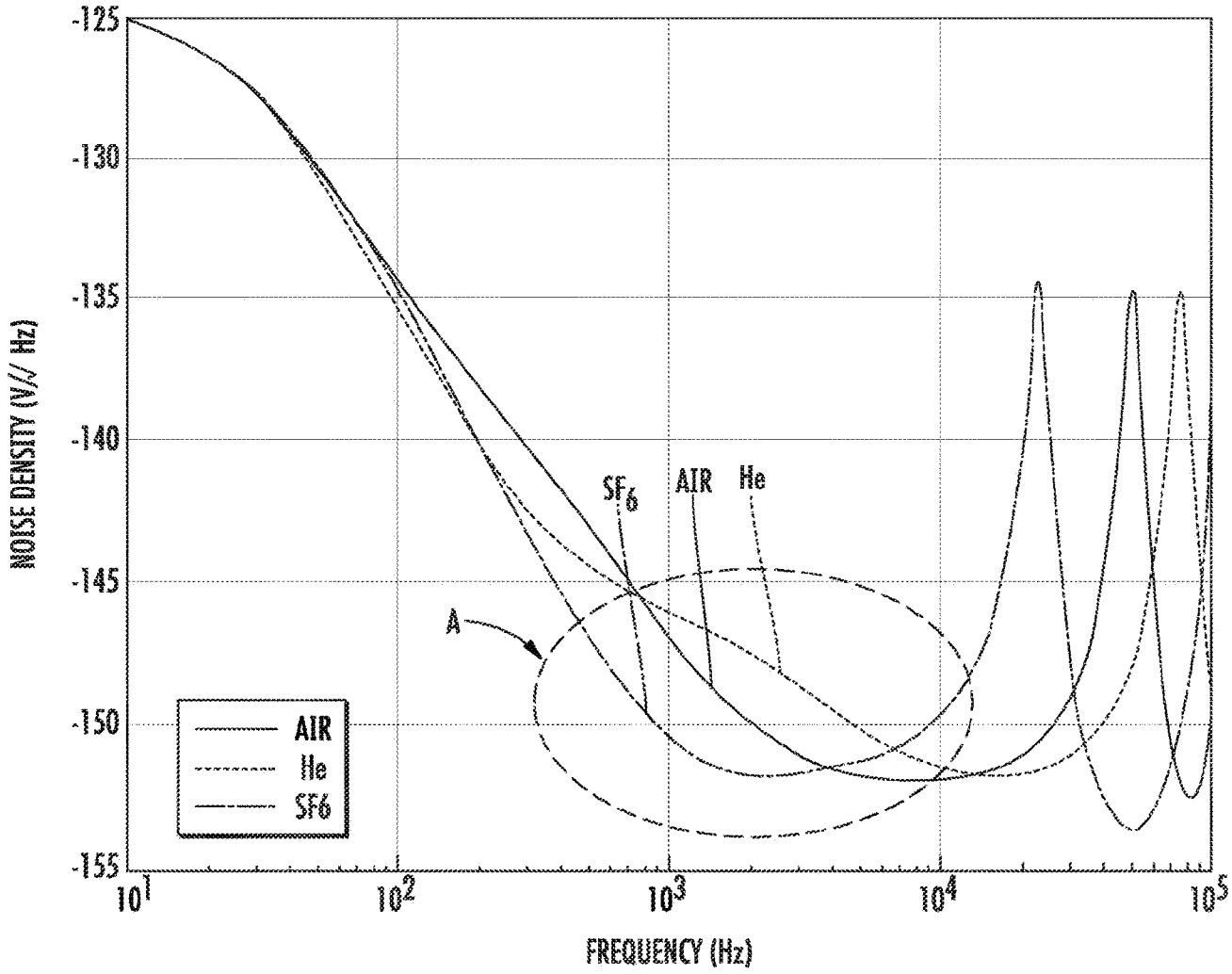
FIG. 5B is a simulated acoustic noise density plot of a microphone assembly using air, helium and sulfur hexafluoride as the backfilled gas.

FIG. 5A is a plot of acoustic spectral noise density vs frequency of microphone assemblies backfilled with air, helium and sulfur hexafluoride, respectively, and FIG. 5B is a simulated acoustic noise density plot of a microphone assembly using air, helium and sulfur hexafluoride as the backfilled gas. Table 1 summarizes the properties of each of the gases used in the experiment and simulation.

TABLE 1

Properties of air, helium (He) and sulfur hexafluoride ($SF_6$)

| Property | Air | Helium | Sulfur Hexafluoride |
|---|---|---|---|
| Density (kg/m$^3$) | 1.21 | 0.164 | 6.26 |
| Thermal Conductivity ($10^{-3}$ W/mK) | 25.7 | 138 | 11.6 |
| Ratio of Heats | 1.4 | 1.6 | 1.098 |
| Speed of Sound (m/s) | 343 | 1007 | 133 |
| Specific Heat (J/kgK) | 1009 | 5190 | 669 |
| Viscosity ($10^{-6}$ Ns/m$^2$) | 18.3 | 19.6 | 16.1 |

As shown in Table 1, sulfur hexafluoride has a lower thermal conductivity, and therefore a slower thermo-acoustic response than air. In contrast, helium has a much higher thermal conductivity than air. As previously described herein, thermal acoustic noise is a greater concern at lower frequencies. The portion of the frequency range where thermal noise is most important is indicated by the arrow A in the plots shown in FIGS. 5A-B. Experiments as well as simulations demonstrated that the smallest acoustic noise is observed for the microphone assembly backfilled with sulfur hexafluoride, while the largest noise is observed for the microphone assembly backfilled with helium.

Figure 6A:
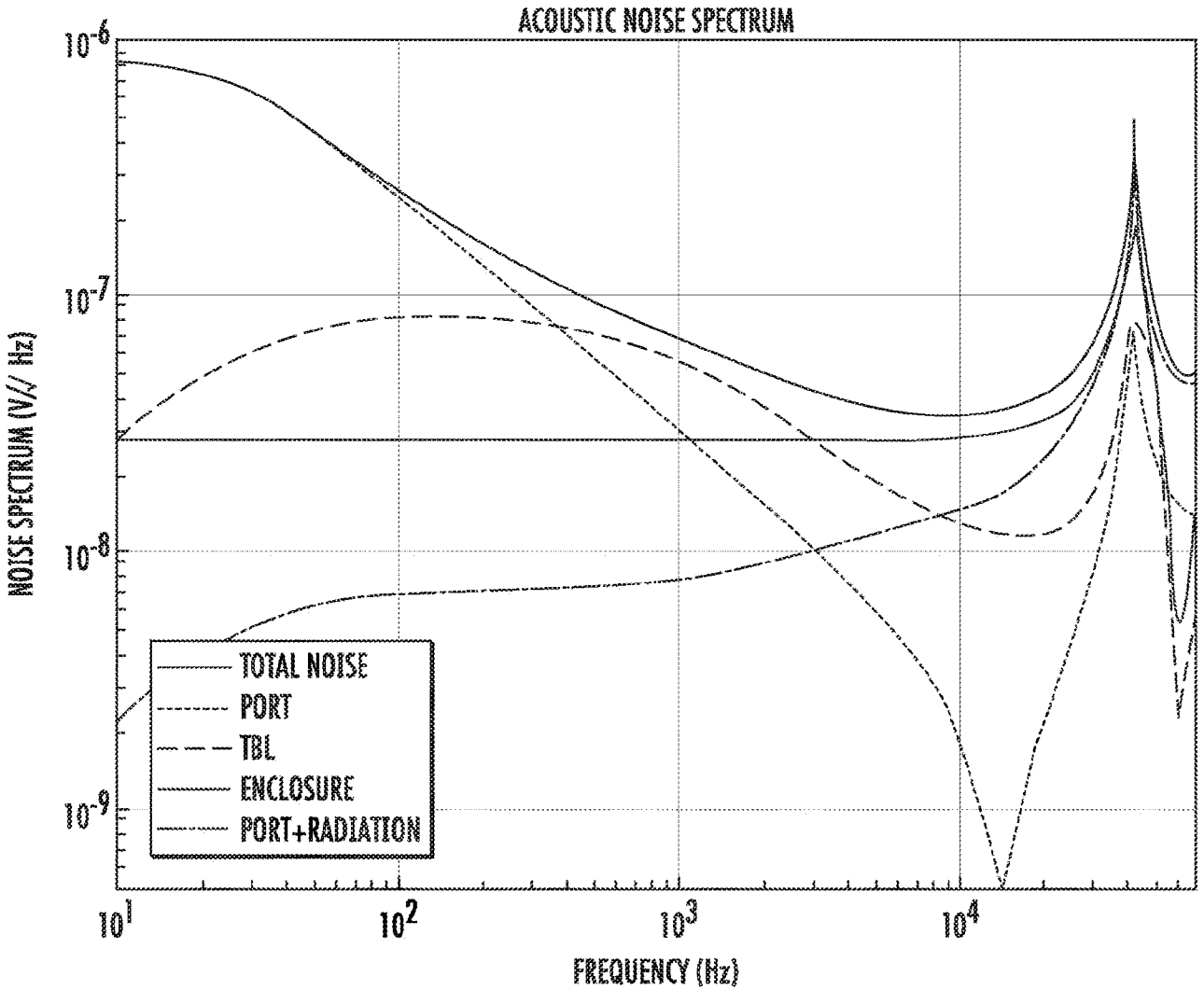
FIG. 6A is a simulated acoustic noise spectrum of different portions of a modeled microphone assembly backfilled with air.
Figure 6B:
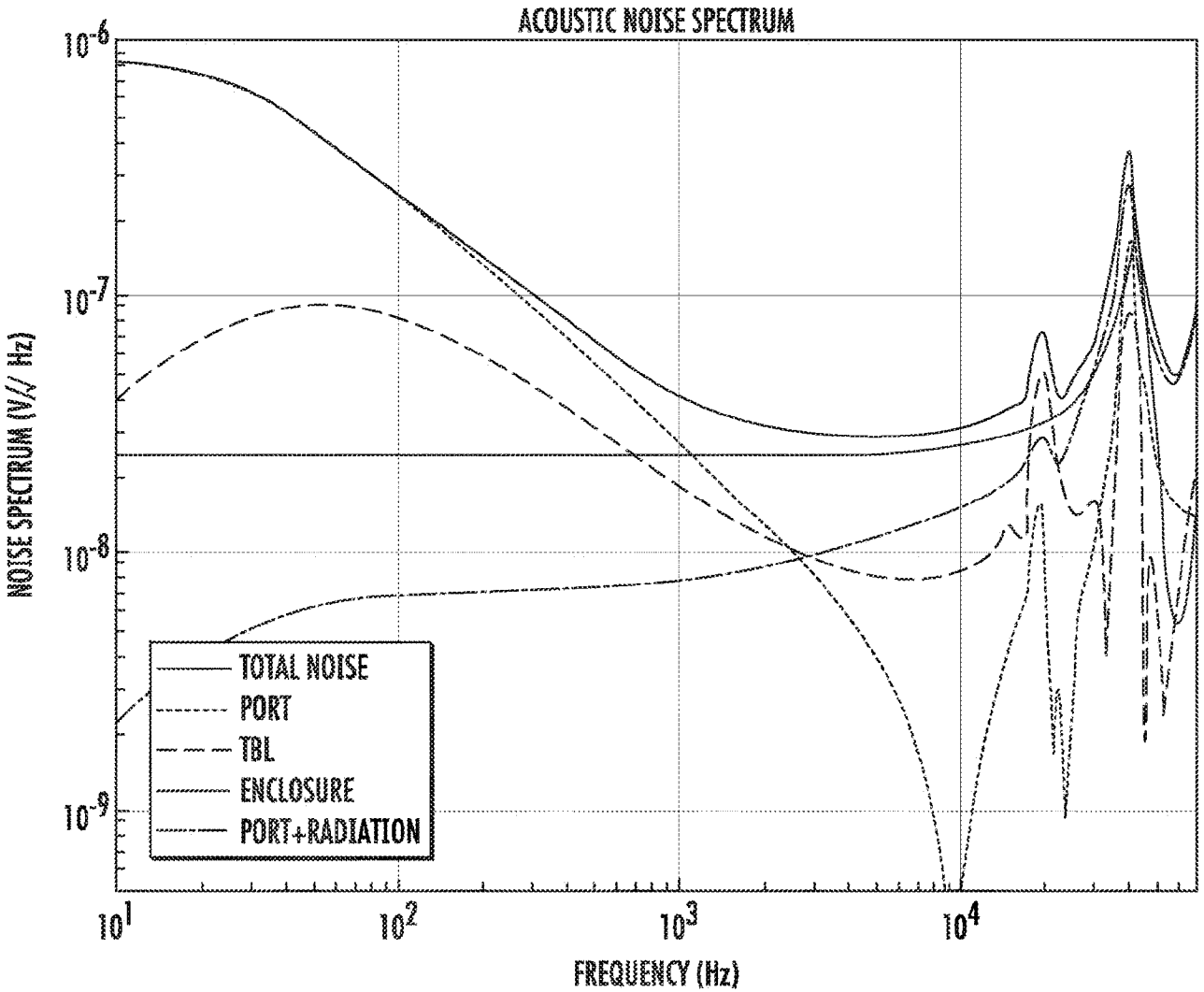
FIG. 6B is a simulated acoustic noise spectrum on different portions of a modeled microphone assembly backfilled with sulfur hexafluoride.
Figure 6C:
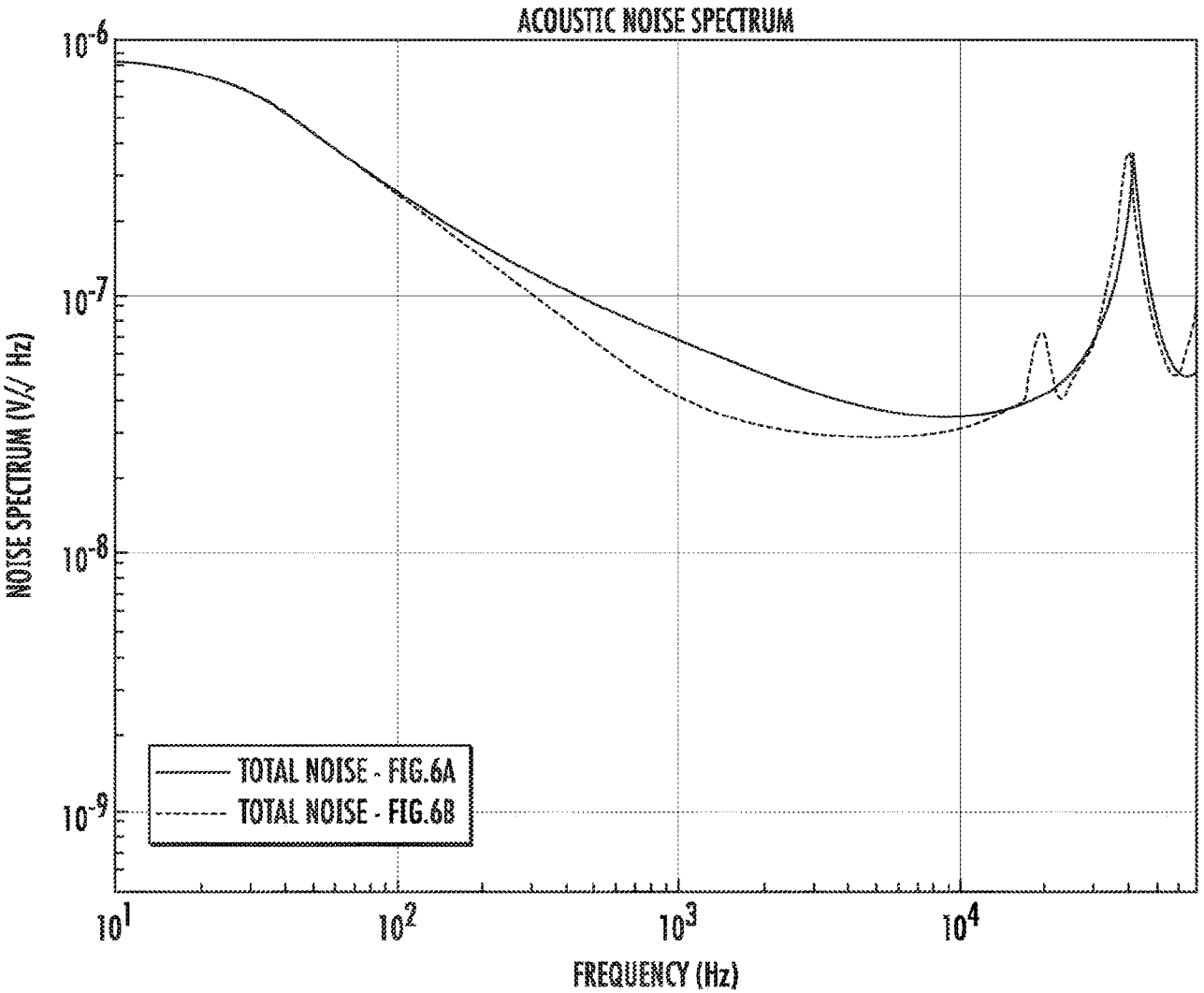
FIG. 6C is a plot comparing total noise from FIG. 6A to total noise from FIG. 6B.

FIG. 6A is a simulated acoustic noise spectrum of different portions of a modeled microphone assembly backfilled with air, FIG. 6B is a simulated acoustic noise spectrum of different portions of the modeled microphone assembly backfilled with sulfur hexafluoride and FIG. 6C is a plot comparing the total noise from FIG. 6A to the total noise from FIG. 6B. The acoustic SNR of the microphone assembly of FIG. 6A backfilled with air is 67.1 dB, while the acoustic SNR of the microphone assembly of FIG. 6B filled with sulfur hexafluoride is 69.0 dB thereby providing almost 2 dB increase in SNR. FIG. 6C compares the total noise derived from FIG. 6A and FIG. 6B.

Figure 7A:
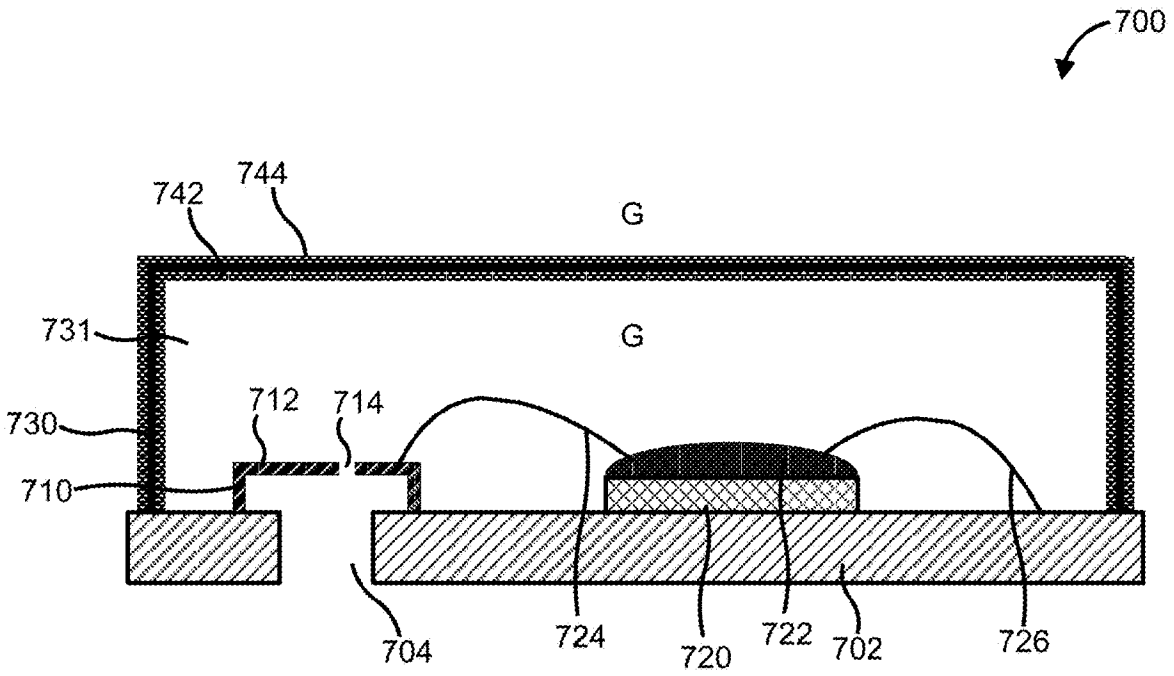
FIG. 7A is a side cross-section view of a microphone assembly, according to another embodiment.

FIG. 7A is a side cross-section view of a microphone assembly 700, according to another embodiment. The microphone assembly 700 may comprise a MEMS microphone assembly. The microphone assembly 700 may be used for generating electrical signals in response to acoustic activity in any device such as, for example, cell phones, laptops, television remotes, tablets, audio systems, head phones, wearables, portable speakers, car sound systems or any other device which uses a microphone assembly.

The microphone assembly 700 comprises a substrate 702. A port 704 is formed in the substrate 702 (i.e., the microphone assembly 700 is a bottom port microphone assembly). An acoustic transducer 710 is positioned on the port 704. The acoustic transducer 710 is configured to generate electrical signals in response to acoustic activity. The acoustic transducer 710 comprises a membrane 712 separating a front volume from a back volume of the microphone assembly 700, the front volume being in fluidic communication with the port 704. An integrated circuit 720 is positioned on the substrate 702. The integrated chip 720 is electrically coupled to the acoustic transducer 710, for example, via a first electrical lead 724 and also to the substrate 702 via a second electrical lead 726. The integrated circuit 720 is configured to receive the electrical signal from the acoustic transducer 710. A protective coating 722 is positioned on the integrated circuit 720. The substrate 702 and the integrated circuit 720 may be substantially similar to the substrate 102 and the integrated circuit 120, respectively and therefore, not described in further detail herein. The acoustic transducer 710 may also be substantially similar to the acoustic transducer 110, however, a throughhole 714 may be provided in the membrane 712 of the acoustic transducer 710 (e.g., pierced in a membrane of the acoustic transducer via drilling, etching or photolithographic masking during deposition of the membrane material on the substrate 702) so as to allow equalization of pressures of a gas G filled in the microphone assembly 700 (e.g., air), and the same gas G surrounding the microphone assembly 700 (e.g., atmospheric air), as described in further detail herein. In other embodiments, pressure equalization may be provided via an opening or vent provided in the enclosure 730.

An enclosure 730 is positioned on the substrate 702 and defines an internal volume 731 within which at least the integrated circuit 720 and the acoustic transducer 710 are positioned. In the implementation shown in FIG. 7A, the internal volume 131 defines the back volume of the acoustic transducer 710. For example, as shown in FIG. 7A, the enclosure 730 is positioned on the substrate 702 such that the substrate forms a base of the microphone assembly 700, and the substrate 702 and the enclosure 730 cooperatively define the internal volume. In the illustrated embodiment, the enclosure 730 is directly coupled to the substrate 702. The enclosure 730 may be formed from any suitable material such, as for example, metals (e.g., aluminum, copper, stainless steel, etc.), plastics, polymers, etc., and may be coupled to the substrate 702, for example, via an adhesive or fusion bonded thereto. In particular embodiment, the enclosure 730 may be formed from a material which has a high thermal conductivity, for example, metals such as copper. The internal volume 731 is filled with a gas G which also surrounds the microphone assembly 700 (e.g., atmospheric air) and may be in fluid communication with the internal volume 731 via the throughhole 714. The throughhole 714 formed through the acoustic transducer 710 may allow for pressure equalization of the gas G within the enclosure 730 to the gas G outside the enclosure by allowing flow of the gas G into and out of the internal volume therethrough.

A first thermal barrier layer 742 is positioned (e.g., deposited or coated) on a first surface of a wall of the enclosure 730 disposed within the internal volume 731, which forms a boundary of the back volume of the acoustic transducer 710. In some embodiments, a second thermal barrier layer 744 may additionally be positioned (e.g., deposited or coated) on a second surface of the wall of the enclosure 730 disposed outside the internal volume 731. In other embodiments, a thermal barrier layer may also be positioned on at least a portion of the substrate 702.

The thermal barrier layers 742/744 may be formulated to have a thermal conductivity less than a thermal conductivity of air. In some embodiments, the thermal barrier layers 742/744 may include an aerogel, for example, a silica aerogel, a carbon aerogel, a metal oxide aerogel, an organic polymer aerogel, a chalcogel, a quantum dot aerogel, any other suitable aerogel or a combination thereof. In particular embodiments, the thermal barrier layers 742/744 may include a silica foam having a pore size of 10-50 nm and having 97% air by mass. The small pore size causes the thermal conductivity of air contained therewithin to be substantially lower (e.g., up to five times lower) than the thermal conductivity of bulk air (e.g., the first gas G1 contained within the internal volume). In some embodiments, the thickness of the aerogel forming the first thermal barrier layer 742 and/or the second thermal barrier layer 744 may be in a range of 50-200 microns (e.g., 50, 60, 70, 80, 90, 100, 110, 120, 130, 140, 150, 160, 170, 180, 190 or 200 microns inclusive of all ranges and values therebetween). In some embodiments, the thickness of the aerogel may be in a range of 135-165 microns (e.g., 135, 140, 145, 150, 155, 160 or 165 microns inclusive of all ranges and values therebetween). The aerogel may be deposited on the first surface and/or the second surface of the wall of the enclosure 730 using any suitable method such as, for example, physical or chemical vapor deposition, immersion coating, drop coating, spray coating, spin coating, any other suitable method or a combination thereof.

The first thermal barrier layer 742 provides thermal insulation to the walls of the enclosure 730 or any other surface on which the thermal barrier is disposed. This reduces heat transfer between the gas G (e.g., air) disposed within the internal volume of the enclosure 730, and the surfaces of the enclosure 730, thereby reducing thermo-acoustic noise.

In some implementations, the first thermal barrier layer 742 may be structured (e.g., via selection of type and/or thickness of the material) to be acoustically compliant, such that, when pressurized, the pressurized air is stored by the first thermal barrier layer 742, and the pressurized air is released by first thermal barrier layer 742 when the pressure is released. In some such implementations, the first thermal barrier layer 742 may be structured not to be acoustically absorbent, such that the first thermal barrier layer 742 generally does not convert a substantial amount of acoustic energy to heat; rather, the first thermal barrier layer 742 may be structured such that it transmits heat to the walls of the microphone instead of absorbing heat. In some embodiments, the first thermal barrier layer 742 may be structured to achieve or approach adiabatic compression, such that the work performed on the air by the first thermal barrier layer 742 causes the temperature of the pressurized air to increase.

In some implementations, the first thermal barrier layer 742 may be an aerogel (e.g., of any of the types discussed above) having a thickness below a threshold thickness. In various embodiments, the aerogel or other type of first thermal barrier layer 742 may have a thickness of less than 12.5 microns, less than 25 microns, less than 50 microns, less than 100 microns, less than 200 microns, or less than 400 microns. In some implementations, the first thermal barrier layer 742 may also have a thickness greater than a second threshold thickness, such as 1 microns. For example, the level of insulation for layers above a threshold thickness may not be limited by the thermal resistance through the material, but rather by the thermal capacity of the heat stored in the material itself. Thus, it is possible that, below a threshold thickness, the level of insulation may be limited by the thermal resistance of the material.

Figure 7B:
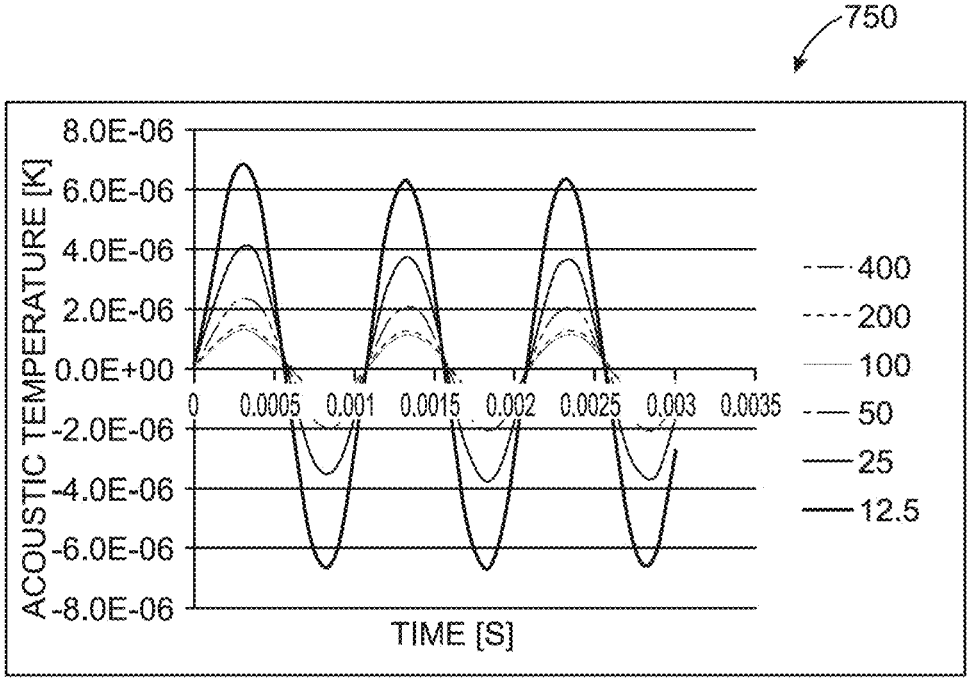
FIG. 7B is a graph of simulated results of variation in acoustic temperature over time for different thickness of the first thermal barrier layer at an acoustic frequency of 1 kHz for a microphone assembly similar to that of FIG. 7A.
Figure 7C:
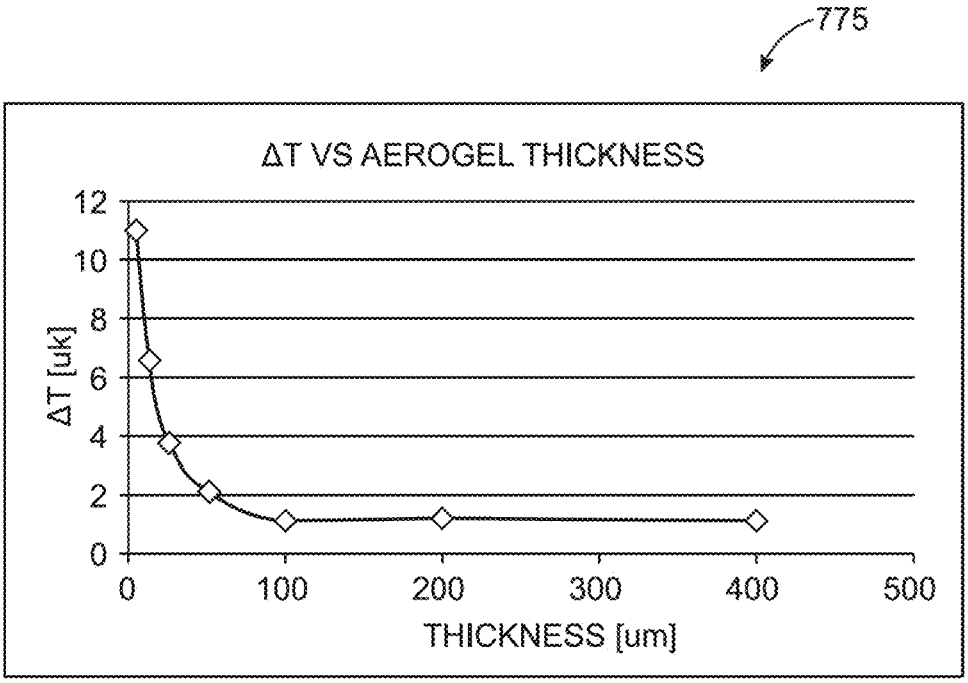
FIG. 7C is a graph of simulated of thickness of the first thermal barrier layer versus the change in acoustic temperature for a microphone assembly similar to that of FIG. 7A.

FIG. 7B illustrates a graph 750 of simulated results of variations of acoustic temperature over time for different thicknesses of the first thermal barrier layer for a microphone assembly similar to that of FIG. 7A. FIG. 7C illustrates another graph 775 of the simulated results in a different format, showing the amount of change in temperature (e.g., maximum change in temperature) as a function of thickness of the first thermal barrier layer. Graphs 750 and 775 illustrate simulated results for a range of thicknesses from 5 microns to 400 microns at an acoustic frequency of 1 kHz. As can be seen in graphs 750 and 775, the first thermal barrier layer exhibits greater swings in temperature, and is closer to achieving adiabatic compression, as the thickness of the material decreases, particularly for thicknesses below 50 microns at the selected acoustic frequency. It is to be expected that if the acoustic frequency is changed, the thickness at which the first thermal barrier layer exhibits greater swings in temperature will change accordingly.

While portions of the discussion above refer specifically to the first thermal barrier layer 742, it should be understood that the concept may additionally, or alternatively, be applied equally to the second thermal barrier 744. Also, it should be understood that various implementations may utilize only one of the first thermal barrier layer 742 or the second thermal barrier layer 744 or may utilize both layers.

Figure 8:
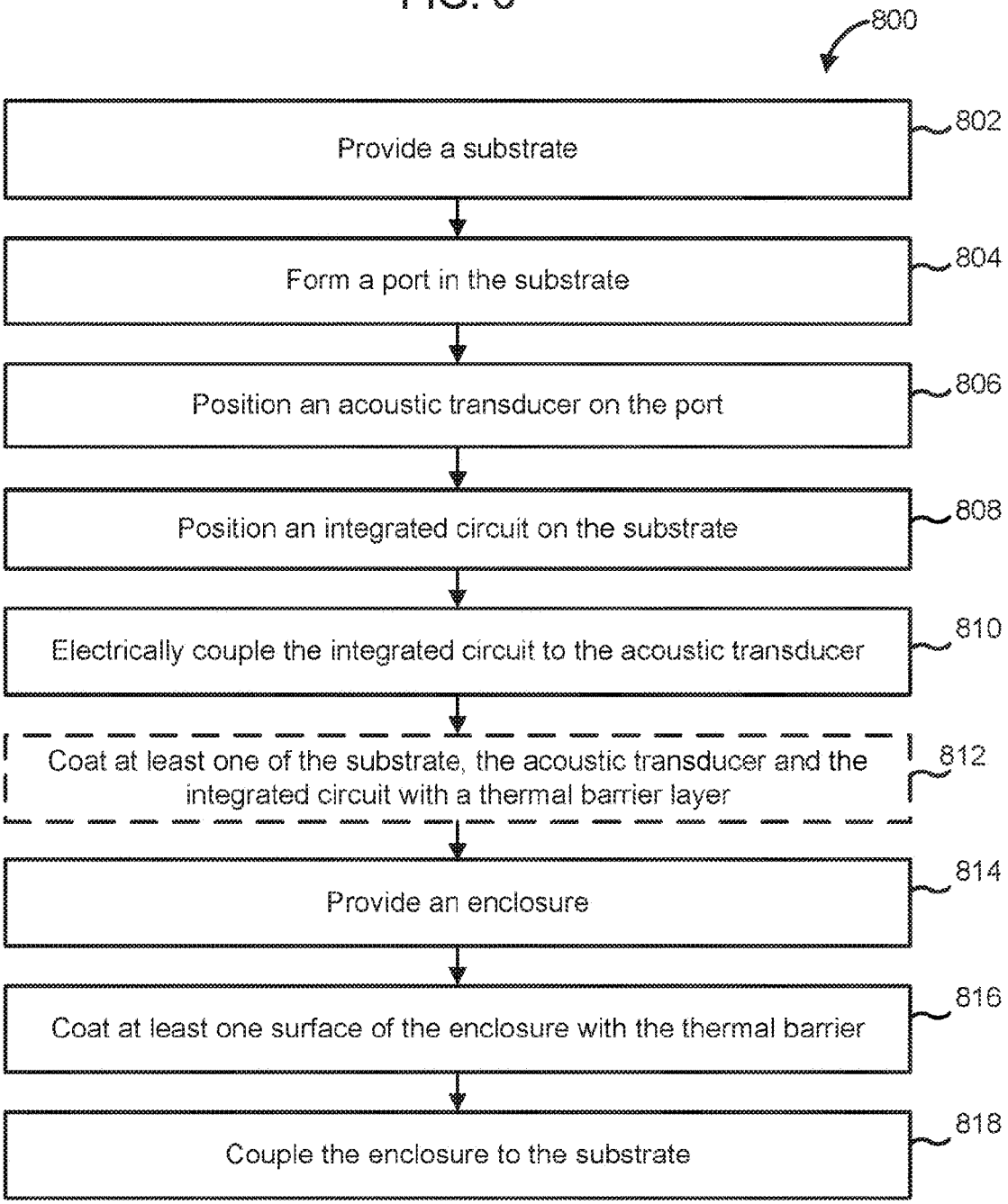
FIG. 8 a schematic flow diagram of a method for fabricating a microphone assembly, according to still another embodiment.

FIG. 8 is a schematic flow diagram of an example method 800 for fabricating a microphone assembly (e.g., the microphone assembly 700), according to an embodiment. The method 800 may comprise providing a substrate, at 802. The substrate may comprise, for example, the substrate 702 or any other substrate described herein. At 804, a port is formed in the substrate. For example, the port 704 may be formed in substrate 702 (e.g., chemically etched, physically etched, drilled, etc.).

At 806, an acoustic transducer is positioned on the port. For example, the acoustic transducer 710 (e.g., a membrane) is positioned on the port 704. The port 704 may be formed using any suitable method, for example, drilling, physical etching, chemical etching, or during a molding process of the substrate. At 808, an integrated circuit is positioned on the substrate. For example, the integrated circuit 720 or any other integrated circuit described herein is positioned on the substrate 702.

At 810, the integrated circuit is electrically coupled to the acoustic transducer. For example, the integrated circuit 720 is electrically coupled to the acoustic transducer 710 via the first electrical lead 724 (e.g., wire bonded thereto). The integrated circuit 720 may also be electrically coupled to the substrate 702 (e.g., view reflow or fusion bonding to contact pads positioned on the substrate 702). In other embodiments, a protective coating (e.g., the protective coating 722) may also be deposited on the integrated circuit (e.g., the integrated circuit 720).

In some embodiments, at least one surface of the substrate, the acoustic transducer and the integrated circuit is coated with a thermal barrier layer. For example, at least one surface of the substrate 702, the acoustic transducer 710 and integrated circuit 720 may be coated with a thermal barrier layer, for example, an aerogel, an inorganic metal oxide or any other thermal barrier layer described herein.

At 814, an enclosure is provided. For example, the enclosure may include the enclosure 730 or any other enclosure described herein. At 816, at least one surface of the enclosure is coated with a thermal barrier layer. For example, the first surface of a wall of the enclosure 730 disposed within the internal volume 731 may be coated with the first thermal barrier layer 742. Furthermore, the second surface of the wall of the enclosure 730 disposed outside the internal volume 731 may additionally be coated with the second thermal barrier layer 744. At 818, the enclosure is coupled to the substrate. For example, the enclosure 730 may be positioned on the substrate 702 and coupled thereto (e.g., via an adhesive or fusion bonded thereto).

Figure 9:
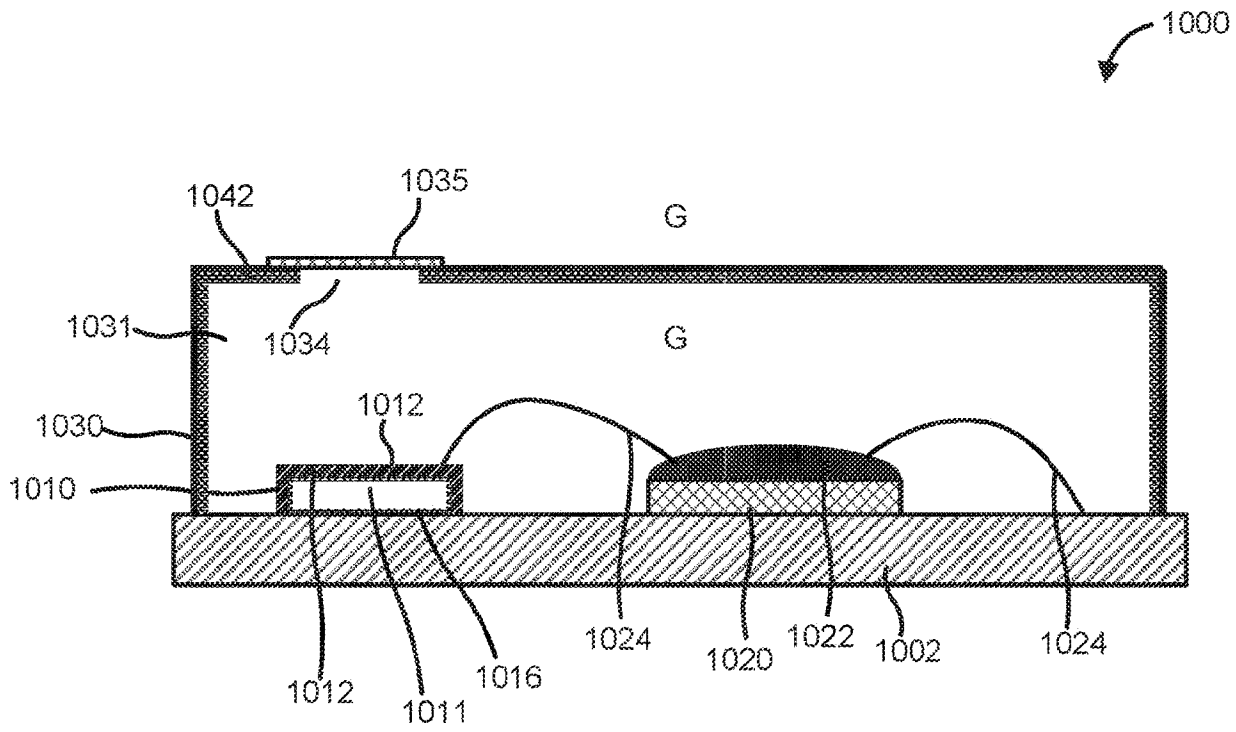
FIG. 9 is a side cross-section view of a microphone assembly, according to another embodiment.

While embodiments of a microphone assembly having a thermal barrier coating have generally been described with the port being defined in the substrate (i.e., a bottom-port microphone assembly), in some embodiments, the port may be defined in an enclosure of the microphone assembly (i.e., a top-port microphone assembly). For example, FIG. 9 is a side cross-section view of a microphone assembly 1000, according to another embodiment. The microphone assembly 1000 may be a MEMS microphone assembly. The MEMS microphone assembly 1000 may be used for generating electrical signals in response to acoustic activity in any device such as, for example, cell phones, laptops, television remotes, tablets, audio systems, head phones, wearables, portable speakers, car sound systems or any other device which uses a microphone assembly.

The microphone assembly 1000 comprises a substrate 1002. The substrate is 1002 generally similar to the substrate 702 of the microphone assembly 700, but does not include a port defined therein. An acoustic transducer 1010 is positioned on the substrate 1002. The acoustic transducer 1010 is configured to generate electrical signals in response to acoustic activity. The acoustic transducer 1010 comprises a membrane 1012 separating a front volume from a back volume of the microphone assembly 1000.

An integrated circuit 1020 is positioned on the substrate 1002. The integrated circuit 1020 is electrically coupled to the acoustic transducer 1010, for example, via a first electrical lead 1024 and also to the substrate 1002 via a second electrical lead 1026. The integrated circuit 1020 is configured to receive the electrical signal from the acoustic transducer 1010. In some implementations, a protective coating 1022 may be positioned on the integrated circuit 1020. The integrated circuit 1020 may be substantially similar to the integrated circuit 120, and therefore, not described in further detail herein.

An enclosure 1030 is positioned on the substrate 1002 and defines an internal volume within which at least the integrated circuit 1020 and the acoustic transducer 1010 are positioned. For example, as shown in FIG. 9, the enclosure 1030 is positioned on the substrate 1002 such that the substrate 1002 forms a base of the microphone assembly 1000, and the substrate 1002 and the enclosure 1030 cooperatively defines the internal volume 1031. The internal volume 1031 is filled with a gas G which also surrounds the microphone assembly 1000 (e.g., air).

The enclosure 1030 may be substantially similar to the enclosure 730 of the microphone assembly 700 with the following differences. A port 1034 is defined in a wall of the enclosure 1030 and may be configured to allow acoustic signals to enter the internal volume as well transport of the gas G into or out of the internal volume 1031. Thus, the internal volume 1031 defines the front volume, and a space 1011 between the acoustic transducer 1010 and the substrate 1002 (e.g., between the membrane 1012 and the substrate 1002) defines the back volume. In some implementations, a mesh 1035 may be positioned over the port 1034 (e.g., in an indented surface of the wall of the enclosure 1030), for example, to prevent dust or debris from entering the internal volume 1031.

A first thermal barrier layer 1016 may be disposed on a surface of boundary defining the back volume. For example, as shown in FIG. 9, the first thermal barrier layer 1016 may be positioned on a portion of the substrate 1002 and/or the acoustic transducer 1010 located within the space 1011. In some embodiments, a second thermal barrier layer 1042 may be positioned (e.g., deposited or coated) on a first surface of the wall of the enclosure 1030 disposed within the internal volume 1031, which forms a portion of a boundary of the front volume. In other embodiments, a thermal barrier layer may also be positioned on at least a portion of the substrate 1002 forming a portion of the boundary of the front volume. The first thermal barrier layer 1016 and the second thermal barrier layer 1042 may be substantially similar to the first thermal barrier layer 742 and the second thermal barrier 744 described with respect to the microphone assembly 700 and, therefore not described in further detail herein.

As previously described herein, the first thermal barrier layer 1016, the second thermal barrier layer 1044 and/or the third thermal barrier layer 1046 provide thermal insulation to the walls of the substrate 1002, the enclosure 1030 or any other surface on which the thermal barrier is disposed. This reduces heat transfer to the gas G (e.g., air) disposed within the back volume and the front volume, therefore reducing heat exchange between the gas G and surfaces of the enclosure 1030, thereby reducing thermo-acoustic noise.

Figure 10:
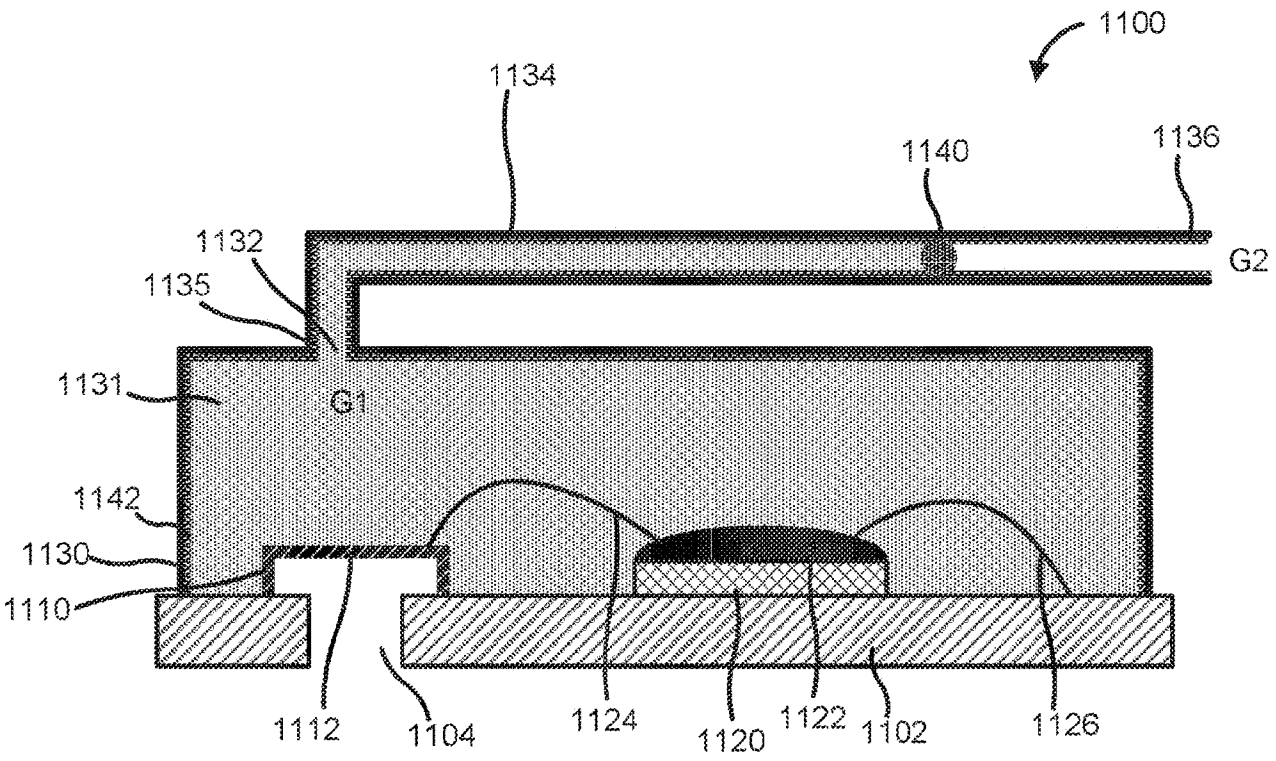
FIG. 10 is a side cross-section view of a microphone assembly, according to yet another embodiment.

FIG. 10 is a side cross-section view of a microphone assembly 1100, according to yet another embodiment. The microphone assembly 1100 may comprise a MEMS microphone assembly. The microphone assembly 1100 may be configured to produce electrical signals in response to acoustic activity in any device such as, for example, cell phones, laptops, television remotes, tablets, audio systems, head phones, wearables, portable speakers, car sound systems or any other device which uses a microphone assembly.

The microphone assembly 1100 comprises a substrate 1102. A port 1104 is formed in the substrate 1102. An acoustic transducer 1110 is positioned on the port 1104. The acoustic transducer 1110 is configured to generate electrical signals in response to acoustic activity. The acoustic transducer 1110 comprises a membrane 1112 separating a front volume from a back volume of the microphone assembly 1100. Furthermore, the acoustic transducer 1110 may not include a hole or piercing. An integrated circuit 1120 is positioned on the substrate 1102. The integrated circuit 1120 is electrically coupled to the acoustic transducer 1110, for example, via a first electrical lead 1124 and also to the substrate 1102 via second electrical lead 1126. The integrated circuit 1120 is configured to receive the electrical signal from the acoustic transducer 1110. A protective coating 1122 may be positioned on the integrated circuit 1120.

An enclosure 1130 is positioned on the substrate 1102 and defines an internal volume within at least the integrated circuit 1120, and the acoustic transducer 1110 are positioned. An opening 1132 is defined in a wall of the enclosure 1130. The microphone assembly 1100 also comprises a conduit 1134. A conduit first end 1135 of the conduit 1134 is fluidly coupled to the opening 1132 and a conduit second end 1136 of the conduit 1134 opposite the conduit first end 1135 is open to the environment, so as to be exposed to a second gas G2 surrounding the microphone assembly 1100 (e.g., ambient or atmospheric air). The substrate 1102, the acoustic transducer 1110, the integrated circuit 1120, the enclosure 1130 and the conduit 1134 may be substantially similar to the substrate 102, the acoustic transducer 110, the integrated circuit 120, the enclosure 130 and the conduit 134, respectively and therefore, not described in further detail herein.

The internal volume of the enclosure 1130 is filled with a first gas G1 which has a thermal conductivity which is lower than a thermal conductivity of the second gas (e.g., ambient air) so as to reduce thermo-acoustic noise of the microphone assembly 1100, as previously described herein. Such gases may include but are not limited to sulfur hexafluoride, xenon, dicholorodifluoromethane, argon, krypton or any suitable combination thereof. In particular embodiments, the second gas comprises sulfur hexafluoride.

In order to fluidly seal the first gas G1 inside the internal volume, as well as allow equalization of pressures of the first gas G1 with the second gas G2, a movable sealing member 1140 is positioned in the conduit 1134. In some embodiments, the movable sealing member 1140 may comprise the movable sealing member 1140 (e.g., a droplet of mineral or synthetic oil such as FOMBLIN®). In other embodiments, the movable sealing member 1140 may comprise the flexible sealing member 340 (e.g., a diaphragm). The movable sealing member 1140 may displace or flex so as to allow balancing of a pressure of the first gas G1 with the ambient pressure of the second gas G2 (e.g., ambient air), as previously described in detail herein.

A first thermal barrier layer 1142 is positioned (e.g., deposited or coated) on a first surface of a wall of the enclosure 1130 disposed within the internal volume. In other embodiments, a thermal barrier layer may also be positioned on at least a portion of the substrate 1102. The first thermal barrier layer 1142 may provide thermal insulation to the walls of the enclosure 1130 or any other surface on which the thermal barrier is disposed so as to reduce thermo-acoustic noise.

Figure 11A:
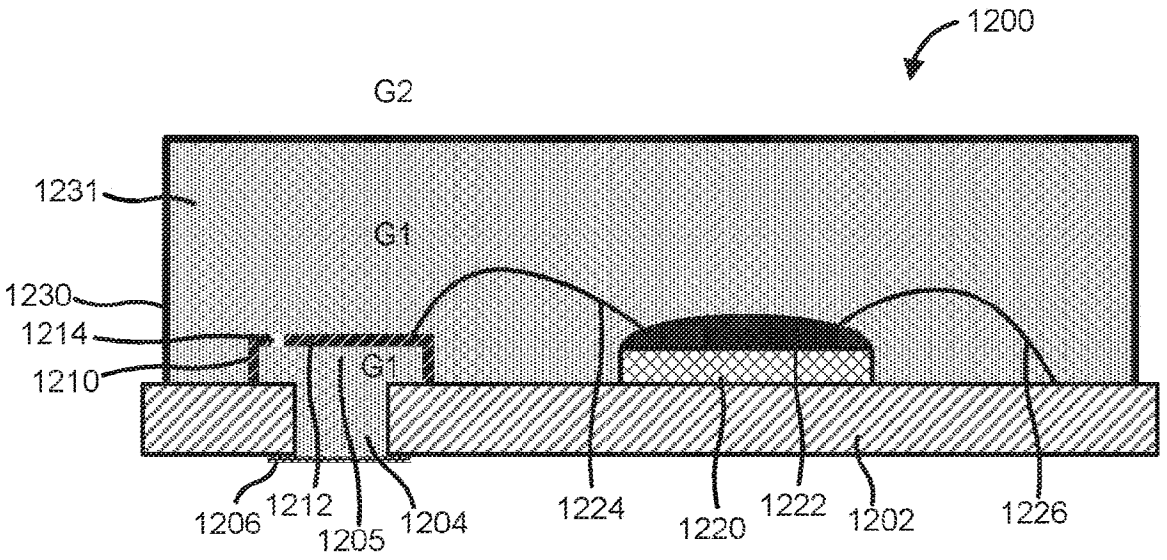
FIG. 11A is a side cross-section view of a microphone assembly, according to an embodiment.

FIG. 11A is a side cross-section of a microphone assembly 1200, according to another embodiment. The microphone assembly 1200 may comprise a bottom port MEMS microphone assembly. The microphone assembly 1200 may be used for recording sound in any device such as, for example, cell phones, laptops, television remotes, tablets, audio systems, head phones, wearables, portable speakers, car sound systems or any other device which uses a microphone assembly.

The microphone assembly 1200 comprises a substrate 1202. A port 1204 is formed in the substrate 1202. An acoustic transducer 1210 may be positioned on the port 1204. The acoustic transducer 1210 is configured to generate an electrical signal responsive to acoustic activity. The acoustic transducer 1210 comprises a membrane 1212 separating a front volume from a back volume of the microphone assembly 1200, the front volume being in fluidic communication with the port 1204. As shown in FIG. 11A, the front volume may include a space 1205 between the substrate 1202 and the acoustic transducer 1210 (e.g., the membrane 1212 of the acoustic transducer 1210) and includes the port 1204.

An integrated circuit 1220 is positioned on the substrate 1202. The integrated circuit 1220 is electrically coupled to the acoustic transducer 1210, for example, via a first electrical lead 1224 and also to the substrate 1202 via a second electrical lead 1226. The integrated circuit 1220 is configured to receive the electrical signal from the acoustic transducer 1210 and/or bias the acoustic transducer 1210. A protective coating 1222 may be positioned on the integrated circuit 1220. The substrate 1202, the acoustic transducer 1210, and the integrated circuit 1220 may be substantially similar to the substrate 102, the acoustic transducer 110 and the integrated circuit 120, respectively and therefore, not described in further detail herein.

An enclosure 1230 is positioned on the substrate 1202 and defines an internal volume 1231 within which at least the integrated circuit 1220 and the acoustic transducer 1210 are positioned. The internal volume 1231 defines the back volume of the microphone assembly 1200. The internal volume 1231 of the enclosure 1230 (i.e., the back volume of the acoustic transducer) is filled with a first gas G1 which has a thermal conductivity which is lower than a thermal conductivity of the second gas G2 (e.g., ambient or atmospheric air). Such gases may include but are not limited to sulfur hexafluoride, xenon, dicholorodifluoromethane, argon, Freon, krypton or any suitable combination thereof. In particular embodiments, the first gas G1 comprises sulfur hexafluoride.

In some implementations, the front volume defined by the space 1205 and the port 1204 may also be filled with the first gas G1. For example, a throughhole 1214 may be provided in the membrane 1212. The first gas G1 may be communicated through the port 1204 so as to fill the first volume. The first gas G1 passes through the throughhole 1214 so as to also fill the back volume defined by the internal volume 1231. A sealing member 1206 (e.g., a thin film or membrane) formed from an acoustically permeably material (e.g., silicone) may be positioned on the port 1204 after filling the front volume and the back volume with the first gas G1 so as to fluidly seal the first gas G1 within the first and second volumes. In other embodiments, an opening or vent may be provided in a wall of the enclosure 1230 so as to allow filling of the back volume with the first gas G1. The opening or vent may then be sealed (e.g., via a film, membrane or adhesive. In still other embodiments, a conduit (e.g., the conduit 134, 334) may be fluidly coupled to the opening or vent, as previously described herein. In such embodiments, the first volume may be filled separately from the second volume such that the throughhole 1214 is excluded from the membrane 1212.

At least a portion of a boundary defining the at least one of the front volume or the back volume may be configured to have compliance so as to allow expansion or contraction of the first gas G1 in response to changes in pressure of the second gas G2 (e.g., atmospheric pressure changes) surrounding the microphone assembly and allow equalization of pressure therewith. For example, one or more sidewalls of the enclosure may be sufficiently compliant so as to allow expansion or contraction of the first gas G1. In other embodiments, the sealing member 1206 may be formed from a compliant material (e.g., silicone rubber or polymers) to allow expansion or contraction of the first gas G1 in response to atmospheric pressure changes. In still other embodiments, a movable sealing member (e.g., the movable sealing member 140, 340) may be positioned in a conduit (e.g., the conduit 134, 334) and provide pressure equalization, as previously described herein. In other implementations, a thermal barrier layer (e.g., any of thermal barrier layers 1016, 1042, 1044) may also be disposed on a surface of a boundary defining the back volume (e.g., inner surfaces of the walls of the enclosure 1230) and/or the front volume (e.g., portion of the substrate 1202 and/or the acoustic transducer 1210 located within the front volume) so as to provide thermal insulation, as previously described herein.

Figure 11B:
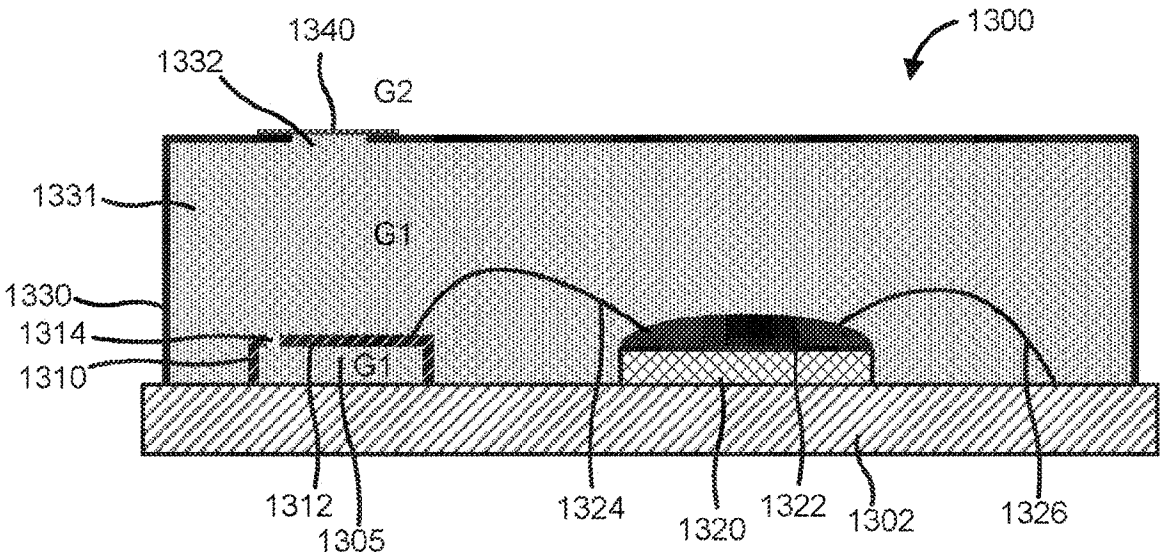
FIG. 11B is a side cross-section view of a microphone assembly, according to another embodiment.

FIG. 11B is a side cross-section of a microphone assembly 1300, according to another embodiment. The microphone assembly 1300 may comprise a top port MEMS microphone assembly. The microphone assembly 1300 may be used for recording sound in any device such as, for example, cell phones, laptops, television remotes, tablets, audio systems, head phones, wearables, portable speakers, car sound systems or any other device which uses a microphone assembly.

The microphone assembly 1300 comprises a substrate 1302. An acoustic transducer 1310 may be positioned on the on the substrate 1302 and is configured to generate an electrical signal responsive to acoustic activity. The acoustic transducer 1310 comprises a membrane 1312 separating a front volume from a back volume of the microphone assembly 1300, the front volume being in fluidic communication with a port 1332 defined in an enclosure 1330 of the microphone assembly 1300.

An integrated circuit 1320 is positioned on the substrate 1302 and electrically coupled to the acoustic transducer 1310, for example, via a first electrical lead 1324 and also to the substrate 1302 via a second electrical lead 1326. The integrated circuit 1320 is configured to receive the electrical signal from the acoustic transducer 1310 and/or bias the acoustic transducer 1310. A protective coating 1322 may be positioned on the integrated circuit 1320. The substrate 1302, the acoustic transducer 1310, and the integrated circuit 1320 may be substantially similar to the substrate 102, the acoustic transducer 110 and the integrated circuit 120, respectively and therefore, not described in further detail herein.

The enclosure 1330 is positioned on the substrate 1302 and defines an internal volume 1331 within which at least the integrated circuit 1320 and the acoustic transducer 1210 are positioned. The port 1332 is defined in the enclosure so that the internal volume 1331 defines the front volume of the microphone assembly 1300. Furthermore, a space 1305 between substrate 1302 and the acoustic transducer 1310 (e.g., the membrane 1312 of the acoustic transducer 1310) defines the back volume of the microphone assembly 1300.

The back volume defined by the space 1305 is filled with a first gas G1 having a thermal conductivity lower than a thermal conductivity of air (e.g., the second gas G2 surrounding the microphone assembly 1300), as previously described herein. Furthermore, the front volume defined by the internal volume 1331 may also be filled with the first gas G1. For example, a throughhole 1314 may be provided in the membrane 1312. The first gas G1 may be communicated through the port 1332 so as to fill the front volume. The first gas passes through the throughhole 1314 so as to also fill the back volume defined by the space 1305. A sealing member 1340 (e.g., a thin film or membrane) formed from an acoustically permeably material (e.g., silicone) may be positioned on the port 1332 after filling the front volume and the back volume with the first gas G1 so as to fluidly seal the first gas G1 within the front and back volumes. In other embodiments, an opening or vent may be provided in the substrate 1302 so as to allow filling of the back volume with the first gas G1. The opening or vent may then be sealed (e.g., via a film, membrane or adhesive). In still other embodiments, a conduit (e.g., the conduit 134, 334) may be fluidly coupled to the opening or vent, as previously described herein.

At least a portion of a boundary defining the front volume or the back volume may be configured to have compliance so as to allow expansion or contraction of the first gas G1 in response to changes in pressure of the second gas G2 (e.g., atmospheric pressure changes) surrounding the microphone assembly and allow equalization of pressure therewith. For example, one or more sidewalls of the enclosure 1330 may be sufficiently compliant so as to allow expansion or contraction of the first gas G1. In other embodiments, the sealing member 1340 may be formed from a compliant material (e.g., silicone rubber or polymers) to allow expansion or contraction of the first gas G1 in response to atmospheric pressure changes. In still other embodiments, a movable sealing member (e.g., the movable sealing member 140, 340) may be positioned in a conduit (e.g., the conduit 134, 334) and provide pressure equalization, as previously described herein. In other implementations, a thermal barrier layer (e.g., any of thermal barrier layers 1016, 1042, 1044) may also be disposed on a surface of a boundary defining the back volume (e.g., inner surfaces of the walls of the enclosure 1230) and/or the front volume (e.g., portion of the substrate 1202 and/or the acoustic transducer 1210 located within the front volume) so as to provide thermal insulation, as previously described herein.

Figure 12:
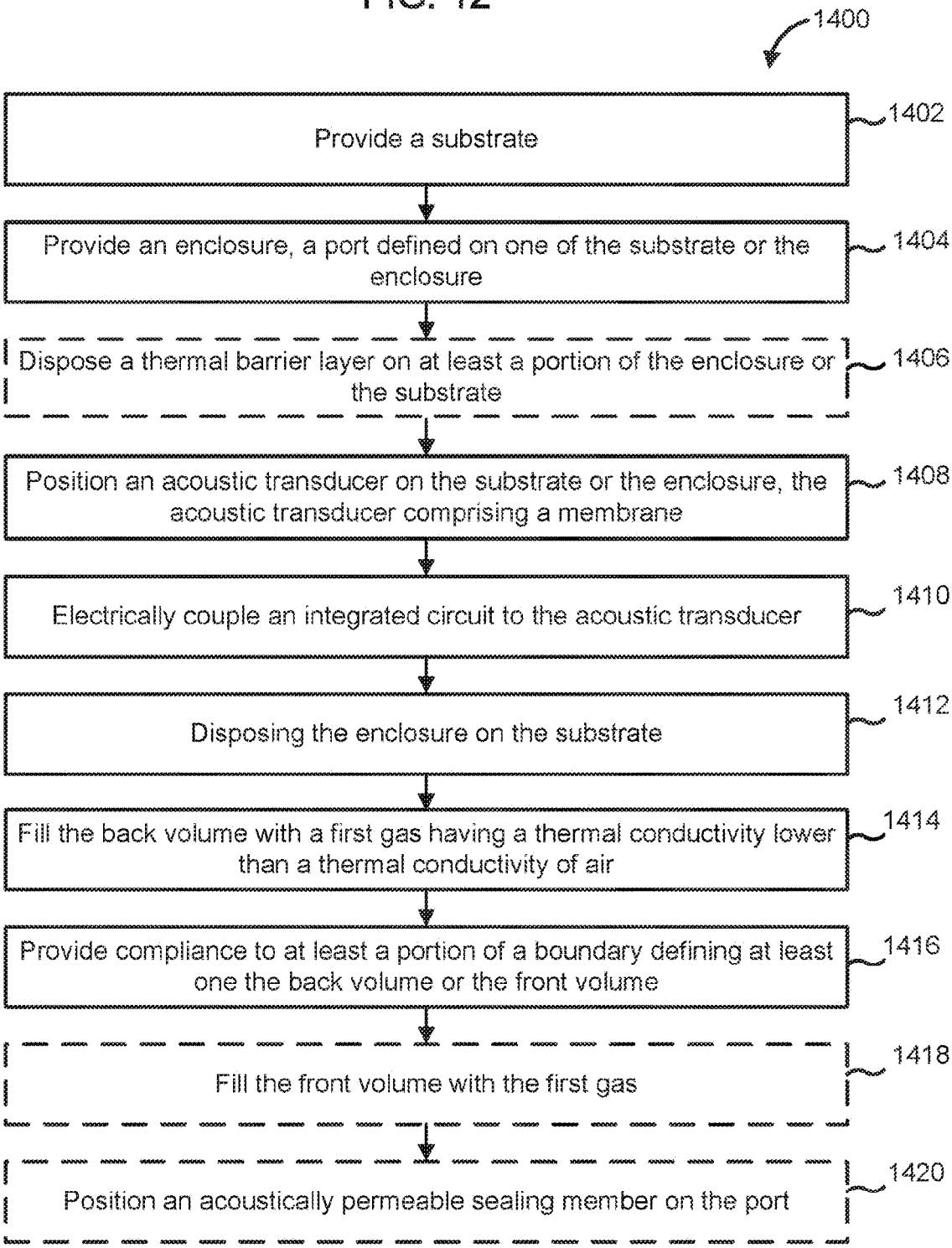
FIG. 12 is a schematic flow diagram of a method for forming a microphone assembly, according to a particular embodiment.
Figure 13A:
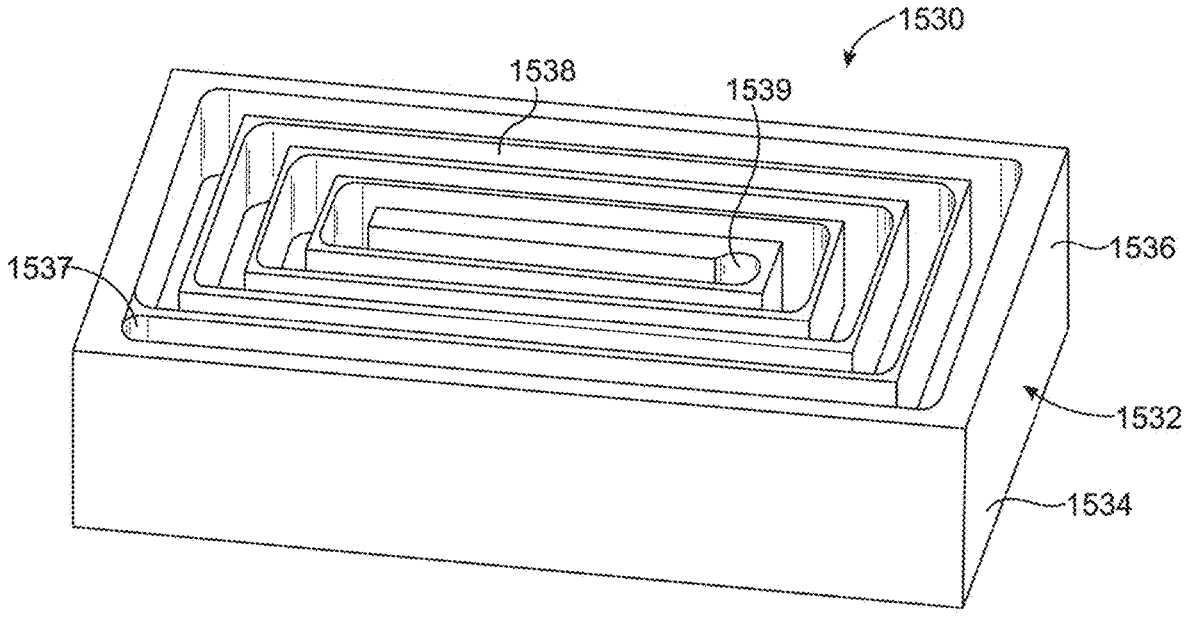
FIG. 13A is a top perspective view of an enclosure for use in a microphone assembly, according to an embodiment.
Figure 13B:
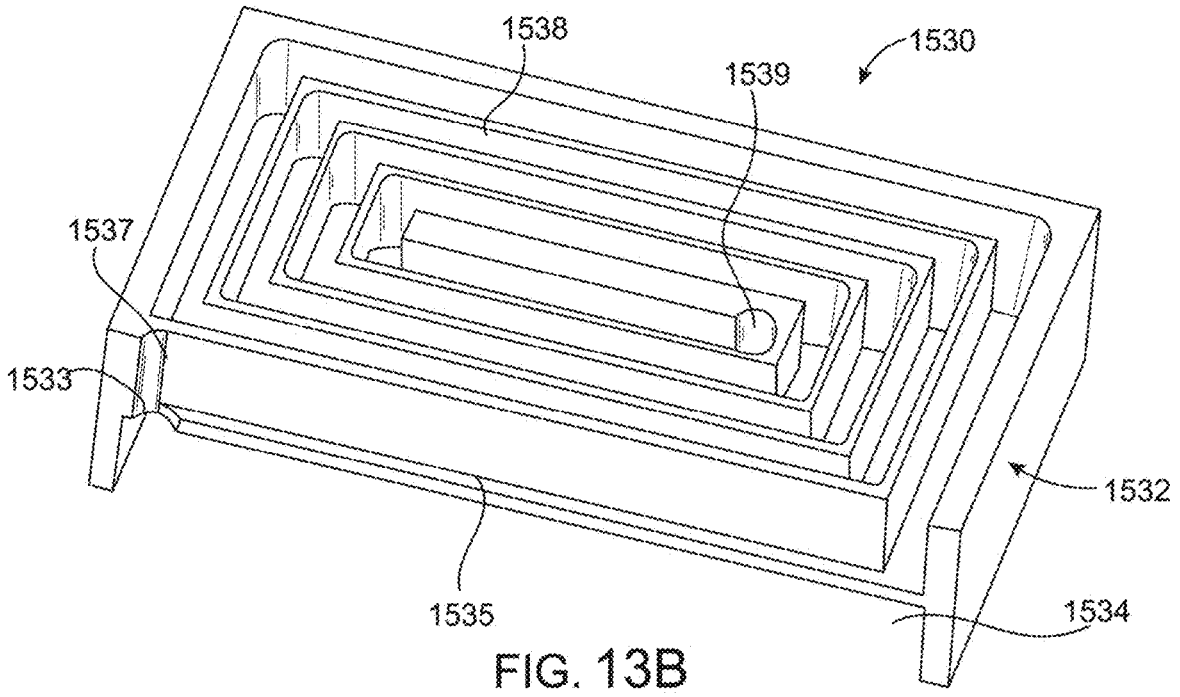
FIG. 13B is a side cross-section view of the enclosure of FIG. 13A.
Figure 13C:
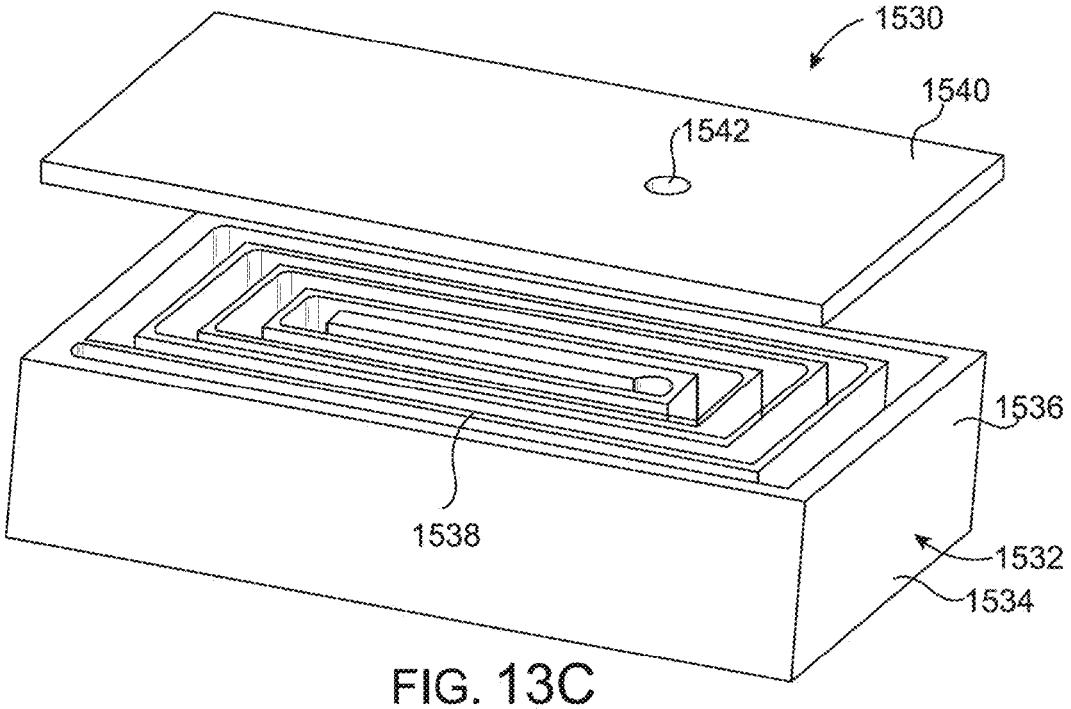
FIG. 13C is a top perspective of the enclosure of FIG. 1A showing a lid configured to be coupled to the enclosure, according to an embodiment.
Figure 13D:
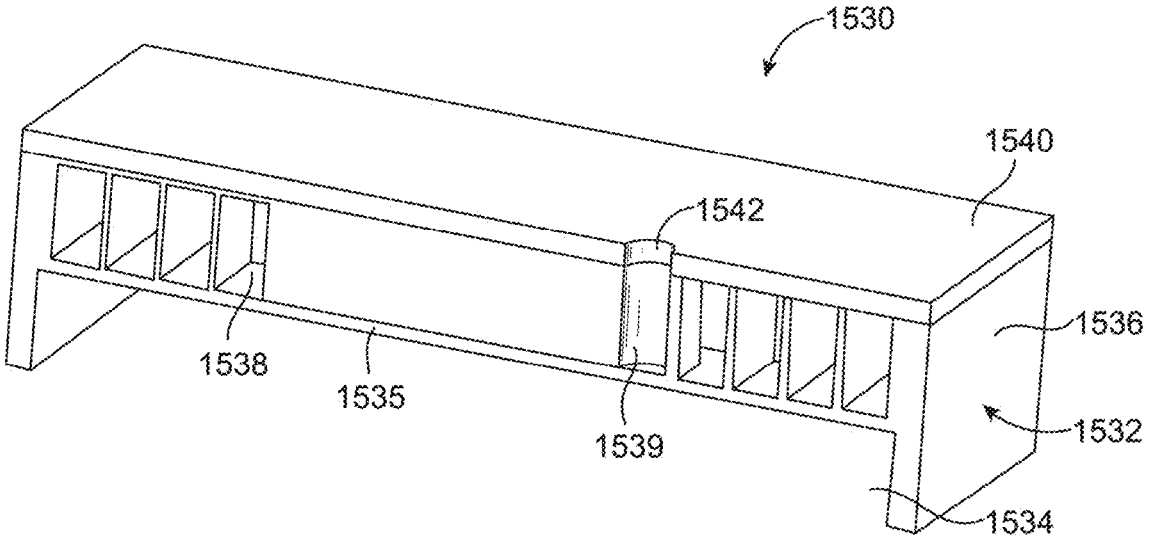
FIG. 13D is another side cross-section view of the enclosure of FIG. 13C with the lid coupled to the enclosure.

FIG. 12 is a schematic flow diagram of a method 1400 for fabricating a microphone assembly (e.g., the microphone assembly 1200, 1300), according to an embodiment. The method 1400 may comprise providing a substrate, at 1402. The substrate may comprise, for example, the substrate 1202, 1302 or any other substrate described herein. At 1404, an enclosure is provided. A port is defined in one of the enclosure or the substrate. For example, the substrate may comprise the substrate 1202 having the port 1204 defined therein, or the enclosure may comprise the enclosure 1330 having the port 1332 defined therein.

In some embodiments, a thermal barrier layer may be disposed on at least a portion of the enclosure or the substrate, at 1406. For example, the first thermal barrier layer 1016 may be disposed on at least a portion of the substrate 1002 or the first and/or second thermal barrier layers 1042, 1044 may be disposed on their respective surface on the enclosure 1030, or any other substrate or enclosure described herein.

At 1408, an acoustic transducer is disposed on one of the substrate or the enclosure. For example, the acoustic transducer 1210, 1310 is positioned on the substrate 1202, 1302. The acoustic transducer comprises a membrane (e.g., the membrane 1212, 1312). In some embodiments, a throughhole (e.g., the throughhole 1214, 1314) is defined in the membrane. At 1410, an integrated circuit is electrically coupled to the acoustic transducer. For example, the integrated circuit 1320 is electrically coupled to the acoustic transducer 1310.

At 1412, the enclosure is disposed on the substrate. For example, the enclosure 1230, 1330 is disposed on the substrate 1202, 1302 such that the acoustic transducer 1210, 1310 are disposed within an internal volume 1231, 1331 defined by the enclosure 1230, 1330.

At 1414, a back volume of the microphone assembly is filled with a first gas having a thermal conductivity lower than a thermal conductivity of air. For example, the back volume defined by the internal volume 1231 of the enclosure 1230 is filled with the first gas G1, or the back volume defined by the space 1305 of the between the substrate 1302 and the acoustic transducer 1310 is filled with the first gas G1, as previously described herein.

At 1416, a compliance is provided to at least a portion of a boundary defining at least one of the front volume or the back volume. For example, one or more sidewalls of the enclosure 1230, 1330 may be sufficiently compliant so as to allow expansion or contraction of the first gas G1. In other embodiments, the sealing member 1206, 1340 may be formed from a compliant material (e.g., silicone rubber or polymers) to allow expansion or contraction of the first gas G1 in response to atmospheric pressure changes. In still other embodiments, a movable sealing member (e.g., the movable sealing member 140, 340) may be positioned in a conduit (e.g., the conduit 134, 334) fluidly coupled to an opening defined in the enclosure (e.g., the enclosure 130, 330) and provide pressure equalization, as previously described herein.

In some embodiments, a front volume of the microphone assembly may also be filled with the first gas, at 1418. For example, the front volume defined by the space 1205 between the substrate 1202 and the acoustic transducer 1210, or the front volume defined by the internal volume 1331 of the enclosure 1330 may also be filled with the first gas G1 as previously described herein. At 1420, an acoustically permeable sealing member may be positioned on the port. For example, the acoustically permeable sealing member 1206, 1340 may be positioned on the port 1204, 1332 so as to fluidly seal the first gas G1 within the back volume and in some implementations, the front volume.

In various embodiments, an enclosure for use with a microphone assembly (e.g., a bottom port microphone assembly) may include a conduit formed within a portion of the enclosure and have a movable sealing member (e.g., a drop of FOMBLIN® oil) disposed therein. For example, FIGS. 13A-D show various views of an enclosure 1530 for use in a microphone assembly (e.g., the microphone assembly 100 or any other microphone assembly described herein). The enclosure 1530 includes a main body 1532 having a first portion 1534 and a second portion 1536. The first portion 1534 may be positioned on a substrate (e.g., the substrate 102) of the microphone assembly and coupled thereto, as described herein. The first portion 1534 defines an internal volume within which components of the microphone assembly, for example, an acoustic transducer (e.g., the MEMS transducer 110) or an integrated circuit (e.g., the integrated circuit 120) may be disposed. Furthermore, the internal volume of the first portion 1534 may be filled with a first gas having a low thermal conductivity, such as the first gas G1 (e.g., sulfur hexafluoride).

The second portion 1536 is fluidly isolated from the internal volume defined by the first portion 1534 by a divider wall 1535 apart from an opening 1533 defined in the divider wall 1535. In some embodiments, the opening 1533 may be defined proximate to a corner of the enclosure 1530. A conduit 1538 is formed in the second portion 1536 and a movable sealing member (e.g., a drop of FOMBLIN® oil is movably disposed in the conduit 1538. The conduit 1538 is fluidly coupled to the first opening 1533 at a conduit first end 1537. The conduit 1538 winds around itself so as to provide an elongated path for the movable sealing member disposed therein to travel in the conduit 1538. The conduit 1538 terminates at a conduit second end 1539 which may be located proximate to an axial center of the divider wall 1535 in the embodiment shown in FIGS. 12A-D. A lid 1540 is positioned on the second portion 1536 and coupled to sidewalls of the second portion 1536 as well as sidewalls forming the conduit 1538 so as to fluidly seal the conduit 1538. An aperture 1542 is defined in the lid 1540 and is structured to align with the conduit second end 1539 for allowing atmospheric air or any other gas surrounding the microphone assembly (e.g., the gas G2) to enter the conduit 1538 through the aperture 1542 into the conduit second end 1539.

While FIGS. 13A-D show the conduit 1538 as having rectangular layout, the conduit 1538 maybe structured to have any other suitable layout for increasing a length available for the movable sealing member to travel within the conduit 1538. For example, in some embodiments, the conduit 1538 may include a helical channel, a double helical channel or a serpentine channel. While the first gas may enter the conduit 1538 through the opening 1533, and the atmospheric air may enter the fluidic channel through the aperture 1542 at the conduit second end 1539, the movable sealing member disposed in the conduit 1538 serves to fluidly isolate the internal volume of the first portion 1534 from the atmosphere. The elongated path of the conduit 1538 provides a long travel length for the movable sealing member, which may allow pressure equalization between the first gas and the atmospheric air even for large changes in atmospheric pressure (e.g., as may be experienced in elevators, at higher elevations, airplane cabin decompression, etc.).

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microphone assembly, comprising:

a substrate;

an enclosure disposed on the substrate, a port defined in one of the substrate or the enclosure;

an acoustic transducer configured to generate an electrical signal responsive to acoustic activity, the acoustic transducer comprising a membrane separating a front volume from a back volume of the microphone assembly, the front volume being in fluidic communication with the port, and the back volume filled with a first gas having a thermal conductivity lower than a thermal conductivity of air; and an integrated circuit electrically coupled to the acoustic transducer and configured to receive the electrical signal from the acoustic transducer, wherein at least a portion of a boundary defining at least one of the front volume or the back volume is configured to have compliance so as to allow expansion or contraction of the first gas in response to changes in pressure of a second gas surrounding the microphone assembly and allow equalization of pressure therewith, the first gas different from the second gas.

2. The microphone assembly of claim 1, wherein the port is defined in the substrate, and wherein the acoustic transducer is positioned on the substrate such that the back volume is defined between the substrate and the enclosure.

3. The microphone assembly of claim 2, wherein an opening is defined in a wall of the enclosure, and wherein the microphone assembly further comprises:

a conduit, a conduit first end fluidly coupled to the opening and a conduit second end opposite the conduit first end open to an environment located outside the microphone assembly; and a moveable sealing member positioned in the conduit and configured to provide the compliance.

4. The microphone assembly of claim 3, wherein the moveable sealing member is configured to move in response to an increase or decrease of a second gas pressure of the second gas surrounding the microphone assembly so as to balance a first gas pressure of the first gas with the second gas pressure.

5. The microphone assembly of claim 3, wherein the moveable sealing member comprises a droplet of at least one of a mineral oil or a synthetic oil.

6. The microphone assembly of claim 5, wherein the moveable sealing member comprises a droplet of a perfluoropolyetheroil.

7. The microphone assembly of claim 1, wherein the first gas comprises at least one of sulfur hexafluoride, xenon, Freon, dicholorodifluoromethane, argon or krypton.

8. The microphone assembly of claim 5, wherein the first gas comprises sulfur hexafluoride.

9. The microphone assembly of claim 1, wherein the port is defined in the substrate, and wherein the first gas comprises at least one of sulfur hexafluoride, xenon, Freon, dicholorodifluoromethane, argon or krypton.

10. The microphone assembly of claim 1, further comprising a thermal barrier layer positioned on at least one interior surface of a boundary defining the back volume, the thermal barrier layer formulated to have a thermal conductivity less than a thermal conductivity of air.

11. A method of forming a microphone assembly, comprising:

providing a substrate;

providing an enclosure, a port defined in one of the substrate or the enclosure;

positioning an acoustic transducer on one of the substrate or the enclosure, the acoustic transducer comprising a membrane, the acoustic transducer configured to generate an electrical signal responsive to acoustic activity;

electrically coupling an integrated circuit to the acoustic transducer;

disposing the enclosure on the substrate such that the membrane separates a space between the substrate and the enclosure into a front volume being in fluidic communication with the port, and a back volume;

filling the back volume with a first gas having a thermal conductivity lower than a thermal conductivity of air; and providing compliance to at least a portion of a boundary defining at least one of the front volume or the back volume so as to allow expansion or contraction of the first gas in response to changes in pressure of a second gas surrounding the microphone assembly and allow equalization of pressure therewith, the first gas different from the second gas.

12. The method of claim 11, wherein the port is defined in the substrate such that the back volume is formed between the membrane and the enclosure, and wherein the method further comprises:

providing an opening in the enclosure, the back volume filled with the first gas through the opening; and operably coupling a movable sealing member to the opening, the movable sealing member providing the compliance.

13. The method of claim 11, further comprising:

filling the front volume with the first gas; and positioning an acoustically permeable sealing member on the port so as to fluidly seal the first gas within the front volume and the back volume.

14. The method of claim 13, wherein a throughhole is defined in the membrane, the throughhole fluidly coupling the front volume to the back volume so as to allow fluidic exchange of the first gas between the front volume and the back volume.

15. The method of claim 11, further comprising disposing a thermal barrier layer on at least a portion of the enclosure or the substrate defining the boundary of the back volume.

16. The method of claim 15, further comprising disposing the thermal barrier layer on at least a portion of the enclosure or the substrate defining a boundary of the front volume.

* * * * *